US011623798B2

(12) United States Patent
Hiltser et al.

(10) Patent No.: US 11,623,798 B2
(45) Date of Patent: Apr. 11, 2023

(54) CONTAINER, CLOSURE, AND METHODS FOR MANUFACTURE

(71) Applicant: H.J. Heinz Company Brands LLC, Pittsburgh, PA (US)

(72) Inventors: Balint Hiltser, Lent (NL); Guus Lueb, Bennekom (NL); Thomas Cox, Norwich (GB); Jamie Fox, Norwich (GB)

(73) Assignee: H.J. Heinz Company Brands LLC, Pittsburgh, PA (US)

( * ) Notice: Subject to any disclaimer, the term of this patent is extended or adjusted under 35 U.S.C. 154(b) by 0 days.

(21) Appl. No.: 17/842,092

(22) Filed: Jun. 16, 2022

(65) Prior Publication Data

US 2022/0315295 A1 Oct. 6, 2022

Related U.S. Application Data

(63) Continuation of application No. 17/353,376, filed on Jun. 21, 2021, now Pat. No. 11,401,083, which is a (Continued)

(51) Int. Cl.
*B65D 47/08* (2006.01)
*B65D 51/24* (2006.01)

(Continued)

(52) U.S. Cl.
CPC ..... *B65D 47/0838* (2013.01); *B65B 3/04* (2013.01); *B65B 7/01* (2013.01); *B65B 7/14* (2013.01);

(Continued)

(58) Field of Classification Search
CPC .. B65D 47/043; B65D 47/06; B65D 47/0804; B65D 47/0833; B65D 47/0838; B65D 51/24

See application file for complete search history.

(56) References Cited

U.S. PATENT DOCUMENTS 3,111,059 A 11/1963 Erwin
3,435,978 A 4/1969 Wittwer (Continued)

FOREIGN PATENT DOCUMENTS

AU 6403596 1/1997
CA 2537719 3/2005

(Continued)

OTHER PUBLICATIONS

International Patent Application No. PCT/US2019/067485, International Search Report, dated May 7, 2020, 4 pages.

(Continued)

*Primary Examiner* — Andrew T Kirsch
(74) *Attorney, Agent, or Firm* — Fitch, Even, Tabin & Flannery LLP

(57) ABSTRACT

In some embodiments, apparatuses and methods provided herein are useful for dispensing a fluid, such as a thixotropic fluid. In some embodiments, a bottle having a closure cap includes a flip top, a base, and a disk, where the base and disk define a mixing chamber configured to facilitate mixing of any serum or liquid separated from the fluid back therein. In some configurations, the base has a central opening through which the fluid exits and an internal shaft with a non-planar end surface opposite the central opening. In some configurations, the non-planar end surface and the disk define channels between the mixing chamber and the internal shaft. In some embodiments, the disk includes a central opening, a plurality of partial annular openings through a planar surface of the disk, and projections extending into the mixing chamber.

24 Claims, 33 Drawing Sheets

Related U.S. Application Data continuation of application No. PCT/US2020/035840, filed on Jun. 3, 2020, which is a continuation-in-part of application No. PCT/US2019/067485, filed on Dec. 19, 2019.

(60) Provisional application No. 62/903,245, filed on Sep. 20, 2019, provisional application No. 62/783,790, filed on Dec. 21, 2018.

(51) Int. Cl.

| | |
|---|---|
| ***B65D 47/04*** | (2006.01) |
| ***B65B 7/01*** | (2006.01) |
| ***B65B 7/14*** | (2006.01) |
| ***B65D 43/02*** | (2006.01) |
| ***B65D 47/20*** | (2006.01) |
| ***B65D 53/02*** | (2006.01) |
| ***B65D 53/04*** | (2006.01) |
| ***B65D 85/72*** | (2006.01) |
| ***B65B 3/04*** | (2006.01) |

(52) U.S. Cl.

CPC ..... *B65D 43/0231* (2013.01); *B65D 47/0804* (2013.01); *B65D 47/0809* (2013.01); *B65D 47/2031* (2013.01); *B65D 51/24* (2013.01); *B65D 53/02* (2013.01); *B65D 53/04* (2013.01); *B65D 85/72* (2013.01); *B65D 47/043* (2013.01); *B65D 2205/02* (2013.01); *B65D 2547/063* (2013.01)

(56) References Cited

U.S. PATENT DOCUMENTS

| | | | |
|---|---|---|---|
| 3,980,211 | A | 9/1976 | Owens |
| 4,057,177 | A | 11/1977 | Laauwe |
| 4,869,399 | A | 9/1989 | Dubach |
| 5,094,361 | A | 3/1992 | Dubach |
| D339,065 | S | 9/1993 | Forsyth |
| D385,791 | S | 11/1997 | Forsyth |
| D441,144 | S | 4/2001 | Vanoncini |
| 6,315,160 | B1 | 11/2001 | Gaiser |
| 6,357,634 | B1 | 3/2002 | Evans |
| D476,892 | S | 7/2003 | Martin |
| 6,616,012 | B2 | 9/2003 | Dark |
| 6,659,308 | B1 | 12/2003 | Kelder |
| D508,853 | S | 8/2005 | Ziegenhorn |
| D511,685 | S | 11/2005 | Choi |
| D531,035 | S | 10/2006 | Pugne |
| 7,195,138 | B2 | 3/2007 | Foster |
| D542,132 | S | 5/2007 | Pugne |
| D594,747 | S | 6/2009 | Moretti |
| 7,552,832 | B2 | 6/2009 | Suffa |
| 7,588,142 | B1 | 9/2009 | Bush |
| D604,159 | S | 11/2009 | Pugne |
| 7,637,402 | B2 | 12/2009 | Romanov |
| D607,726 | S | 1/2010 | Wisniewski |
| D609,092 | S | 2/2010 | Laib |
| D609,568 | S | 2/2010 | Mazurkiewicz |
| D624,414 | S | 9/2010 | David |
| D625,146 | S | 10/2010 | George |
| D627,641 | S | 11/2010 | Mazurkiewicz |
| D628,887 | S | 12/2010 | Groubert |
| D628,888 | S | 12/2010 | Groubert |
| D628,889 | S | 12/2010 | Groubert |
| D628,890 | S | 12/2010 | Groubert |
| D628,891 | S | 12/2010 | Groubert |
| D628,892 | S | 12/2010 | Groubert |
| D628,893 | S | 12/2010 | Groubert |
| D631,347 | S | 1/2011 | Rudolph |
| 7,874,466 | B2 | 1/2011 | McConville |
| D634,198 | S | 3/2011 | Groubert |
| D640,556 | S | 6/2011 | Bragg |
| D673,048 | S | 12/2012 | Waite |
| 8,376,195 | B2 | 2/2013 | Dubach |
| D680,434 | S | 4/2013 | Fracasso |
| 8,424,728 | B2 | 4/2013 | Dubach |
| D688,554 | S | 8/2013 | Fracasso |
| D712,263 | S | 9/2014 | Humm |
| D712,264 | S | 9/2014 | Humm |
| D721,535 | S | 1/2015 | Chapman |
| D742,229 | S | 11/2015 | Wisniewski |
| 9,409,680 | B2 | 8/2016 | Van Alfen |
| D766,085 | S | 9/2016 | Smith |
| D782,310 | S | 3/2017 | Li |
| 9,650,185 | B2 | 5/2017 | Kieffer |
| D789,737 | S | 6/2017 | Eyal |
| D794,458 | S | 8/2017 | Lloyd |
| D809,387 | S | 2/2018 | Tran |
| D809,388 | S | 2/2018 | Tran |
| 9,932,158 | B2 | 4/2018 | Rognard |
| D834,413 | S | 11/2018 | Tran |
| D838,592 | S | 1/2019 | Henderson |
| D842,107 | S | 3/2019 | Bardet |
| 10,252,845 | B2 | 4/2019 | Rognard |
| 10,266,311 | B2 | 4/2019 | Rognard |
| 10,358,273 | B2 | 7/2019 | Benoit-Gonin |
| D863,962 | S | 10/2019 | Bakic |
| 10,427,847 | B2 | 10/2019 | Tiesberger |
| 10,442,591 | B2 | 10/2019 | Rognard |
| 10,618,711 | B2 | 4/2020 | Weir |
| 10,640,270 | B2 | 5/2020 | Port |
| D889,260 | S | 7/2020 | Hiltser |
| 10,926,923 | B2 | 2/2021 | Berroa Garcia |
| 11,059,641 | B2 | 7/2021 | Peuker |
| 11,220,378 | B2 | 1/2022 | Garcia Alberola |
| D949,690 | S | 4/2022 | Hiltser |
| 11,292,642 | B2 | 4/2022 | Hiltser |
| 2001/0052531 | A1 | 12/2001 | Randall |
| 2004/0245290 | A1 | 12/2004 | Hagihara |
| 2005/0087550 | A1 | 4/2005 | Skillin |
| 2005/0087571 | A1 | 4/2005 | Dark |
| 2005/0173457 | A1 | 8/2005 | Berard |
| 2005/0279781 | A1 | 12/2005 | Pugne |
| 2007/0205177 | A1 | 9/2007 | Delage |
| 2007/0251909 | A1 | 11/2007 | Decelles |
| 2008/0023477 | A1 | 1/2008 | Markert |
| 2008/0110850 | A1 | 5/2008 | Tilton |
| 2008/0110933 | A1 | 5/2008 | Goncalves |
| 2008/0237278 | A1 | 10/2008 | Gaus |
| 2009/0159552 | A1 | 6/2009 | Cano-Pey |
| 2009/0294447 | A1 | 12/2009 | Mazurkiewicz |
| 2010/0072231 | A1 | 3/2010 | Bloom |
| 2010/0230438 | A1 | 9/2010 | Vincent, Jr. |
| 2011/0290824 | A1 | 12/2011 | Smith |
| 2012/0080450 | A1 | 4/2012 | Dziersk |
| 2012/0199582 | A1 | 8/2012 | Cai |
| 2013/0043277 | A1 | 2/2013 | Lepage |
| 2013/0175271 | A1 | 7/2013 | Lim |
| 2013/0270295 | A1 | 10/2013 | Collias |
| 2013/0334250 | A1 | 12/2013 | Albaum |
| 2014/0144938 | A1 | 5/2014 | Kakuta |
| 2015/0014370 | A1 | 1/2015 | Kiel |
| 2015/0108180 | A1 | 4/2015 | Advaney |
| 2015/0259108 | A1 | 9/2015 | Rodrigues Neto |
| 2015/0307238 | A1 | 10/2015 | Richards |
| 2015/0353245 | A1 | 12/2015 | Sakimura |
| 2016/0251104 | A1 | 9/2016 | Zweifel |
| 2017/0276531 | A1 | 9/2017 | Jaeckel |
| 2018/0148234 | A1 | 5/2018 | Knight |
| 2019/0166976 | A1 | 6/2019 | Croix |
| 2019/0168932 | A1 | 6/2019 | Jevtic |
| 2019/0270554 | A1 | 9/2019 | Maeda |
| 2019/0276210 | A1 | 9/2019 | Giese |
| 2020/0031540 | A1 | 1/2020 | Dzurik |
| 2020/0399030 | A1 | 12/2020 | Jelich |
| 2020/0407128 | A1 | 12/2020 | Armstrong |
| 2021/0069734 | A1 | 3/2021 | Müller et al. |
| 2021/0114781 | A1 | 4/2021 | Boehm |
| 2021/0171247 | A1 | 6/2021 | Boehm |

(56) References Cited

U.S. PATENT DOCUMENTS

| | | | |
|---|---|---|---|
| 2021/0269198 | A1 | 9/2021 | Rognard |
| 2022/0204224 | A1 | 6/2022 | Hiltser |

FOREIGN PATENT DOCUMENTS

| | | |
|---|---|---|
| CA | 2939346 | 8/2015 |
| CA | 3020455 | 11/2017 |
| CA | 3093560 | 9/2019 |
| CA | 3112028 | 3/2020 |
| CH | 715006 | 11/2019 |
| CH | 715921 | 9/2020 |
| DE | 20112974 | 9/2002 |
| DE | 202007019300 | 12/2011 |
| DE | 102015101946 | 8/2016 |
| DE | 202017101589 | 7/2017 |
| DE | 102016014640 | 5/2018 |
| DE | 202017007371 | 1/2021 |
| EP | 1660383 | 5/2006 |
| EP | 1663801 | 6/2006 |
| EP | 1892194 | 2/2008 |
| EP | 2213584 | 8/2010 |
| EP | 2782841 | 10/2014 |
| EP | 2953862 | 12/2015 |
| EP | 2953863 | 12/2015 |
| EP | 2993447 | 3/2016 |
| EP | 3088851 | 11/2016 |
| EP | 3105138 | 12/2016 |
| EP | 3256395 | 12/2017 |
| EP | 3303166 | 4/2018 |
| EP | 3350094 | 7/2018 |
| EP | 3383756 | 10/2018 |
| EP | 3444201 | 2/2019 |
| EP | 3458163 | 3/2019 |
| EP | 3472065 | 4/2019 |
| EP | 3519316 | 8/2019 |
| EP | 3546170 | 10/2019 |
| EP | 3546386 | 10/2019 |
| EP | 3604163 | 2/2020 |
| EP | 3649056 | 5/2020 |
| EP | 3708512 | 9/2020 |
| EP | 3740433 | 11/2020 |
| EP | 3752432 | 12/2020 |
| EP | 3765376 | 1/2021 |
| EP | 3765382 | 1/2021 |
| EP | 3774262 | 2/2021 |
| EP | 3793912 | 3/2021 |
| EP | 3817989 | 5/2021 |
| EP | 3837182 | 6/2021 |
| EP | 3921246 | 12/2021 |
| JP | 2009161194 | 7/2009 |
| JP | 2016050003 | 4/2016 |
| WO | 0006460 | 2/2000 |
| WO | 0153782 | 7/2001 |
| WO | 2007024404 | 3/2007 |
| WO | 2009046551 | 4/2009 |
| WO | 2009046553 | 4/2009 |
| WO | 2019010154 | 1/2019 |
| WO | 2019137597 | 7/2019 |
| WO | 2019150106 | 8/2019 |
| WO | 2019178363 | 9/2019 |
| WO | 2019186326 | 10/2019 |
| WO | 2019186327 | 10/2019 |
| WO | 2020058023 | 3/2020 |
| WO | 2020132247 | 6/2020 |
| WO | 2021048336 | 3/2021 |
| WO | 2021055026 | 3/2021 |
| WO | 2021055067 | 3/2021 |
| WO | 2021116468 | 6/2021 |
| WO | 2021204360 | 10/2021 |

OTHER PUBLICATIONS

International Patent Application No. PCT/US2020/035840, International Search Report, dated Aug. 20, 2020, 2 pages.

International Patent Application No. PCT/US2020/039387, International Search Report, dated Oct. 8, 2020, 3 pages.

U.S. Design U.S. Appl. No. 29/737,015, filed Jun. 4, 2020, entitled "Closure for a Container" (38 pages).

U.S. Design U.S. Appl. No. 29/834,026, filed Apr. 8, 2022, entitled "Closure for a Container".

U.S. Design U.S. Appl. No. 29/834,025, filed Apr. 8, 2022, entitled "Closure for a Container".

CONTAINER, CLOSURE, AND METHODS FOR MANUFACTURE

CROSS-REFERENCE TO RELATED APPLICATIONS

This application is a continuation of U.S. application Ser. No. 17/353,376, filed Jun. 21, 2021, now issued as U.S. Pat. No. 11,401,083, which is a continuation of International Application No. PCT/US2020/035840, filed on Jun. 3, 2020, which is a continuation-in-part of International Application No. PCT/US2019/067485, filed Dec. 19, 2019, which claims the benefit of U.S. Provisional Application No. 62/903,245, filed Sep. 20, 2019, and claims the benefit of U.S. Provisional Application No. 62/783,790, filed Dec. 21, 2018, all of which are incorporated herein by reference in their entirety.

TECHNICAL FIELD

This disclosure relates generally to containers for fluids. More particularly, this disclosure generally relates to containers with closure caps.

BACKGROUND

Fluid containers occasionally have issues with dosing and leakage, especially during shipping and/or when the containers are placed in certain configurations. Many consumer products delivered in bottles may suffer from such drawbacks. By way of example, thixotropic fluids, such as, for example, ketchup or certain liquid soaps, are sometimes sold in bottles that use a flexible plastic membrane valve with an "X" shaped slit. These are sometimes used with inverted bottles that rest on their caps when not in use so that gravity retains the product in position adjacent the valve.

One problem with this type of valve is that in some cases, product may leak through the valve when the bottle is not in use. Another problem is that during dispensing, product may squirt from the opening at an undesirably high velocity, increasing the risk of splatter. The high velocity of the product being discharged also makes proper dosing difficult because there is generally insufficient control over the product at high velocities. A third problem is that the valve may resist or prevent inflow of air to maintain interior volume after dispensing, leading to development of subatmospheric pressure, i.e., a partial vacuum, in the bottle. This can lead to paneling, i.e., buckling, or other undesirable inward deflection of container walls, which can be esthetically problematic and also functionally problematic, as it may increase the manual pressure required to dispense product, and may lead to uneven or inconsistent dispensing in response to a squeeze, i.e., manual application of pressure to the container exterior.

Another issue is that such membrane valves are often formed of silicon, whereas other portions of the caps are often formed of another material such as polypropylene. Having a closure cap comprised of multiple materials increases the complexity and cost of manufacturing and can make recycling difficult and/or impractical, thereby making the solution less attractive for large scale use.

Further, such membrane valves and other similar solutions do not always sufficiently address product separation that often occurs in fluids, such as when serum, water or another thin liquid component of relatively low viscosity separates from the remainder of a fluid such as ketchup. This separation can increase leakage, increase splatter, and cause the thin liquid component to be dispensed separately from the remainder of the product.

BRIEF DESCRIPTION OF THE DRAWINGS

Disclosed herein are embodiments of systems, apparatuses and methods pertaining to a container, closure and methods for manufacturing. This description includes drawings, wherein.

Figure 1A:
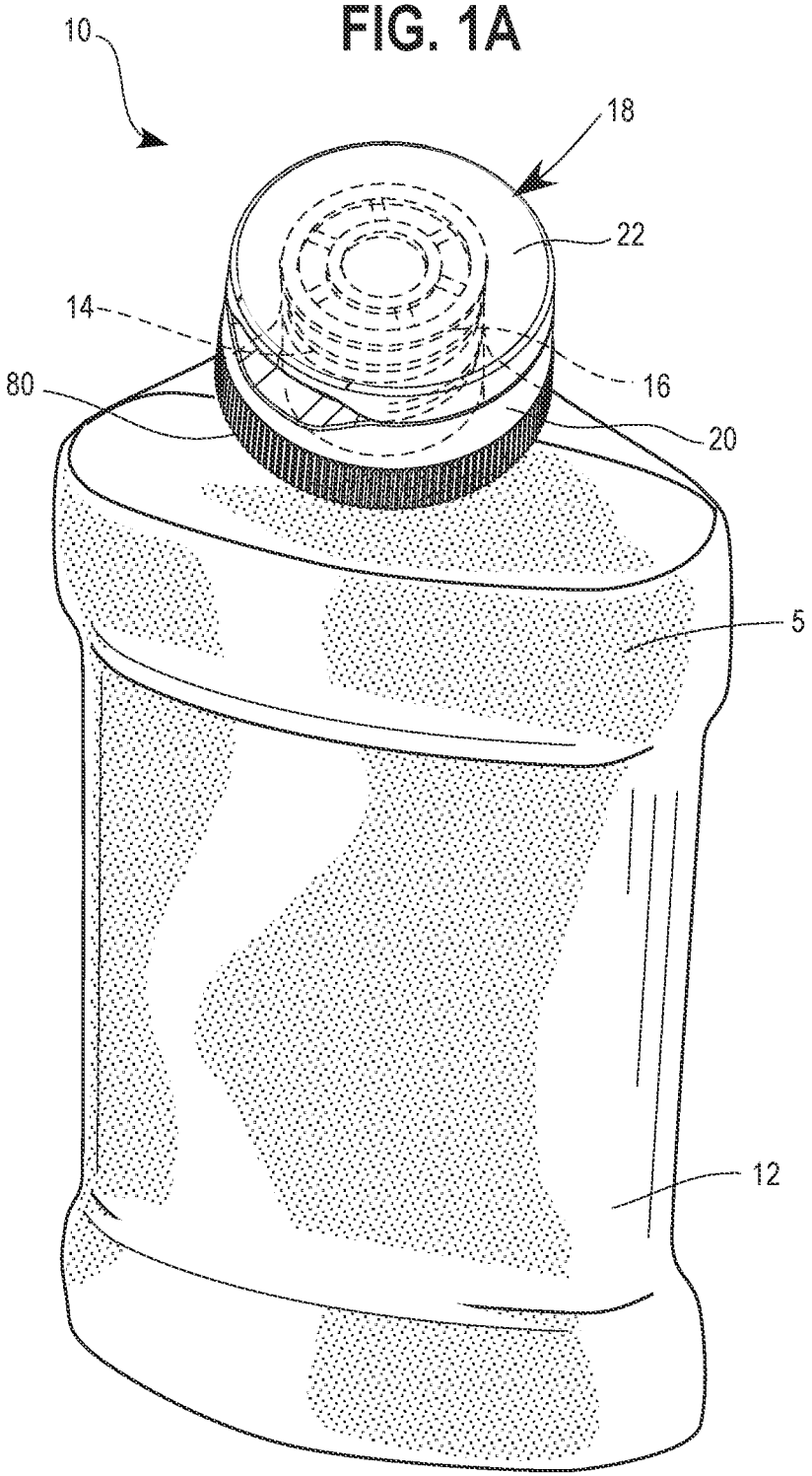
FIG. 1A is a perspective view of a bottle with a cap in accordance with some embodiments.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment may be omitted in order to facilitate a less obstructed view of these various embodiments of the present invention. Certain actions and/or steps may be described or depicted in a particular order of occurrence when such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Described herein are systems, apparatus and methods that are useful to dispense a fluid, such as, for example, a thixotropic fluid, from a bottle. Some embodiments include a closure cap for such a bottle. The closure cap may include a flip-top, a base, and a disk, where the base and disk define a mixing chamber configured to facilitate mixing of the fluid, which may mix serum or liquid separated from the fluid back therein. In some configurations, the base has a central opening through which the fluid exits, and a hollow internal shaft with a non-planar end surface opposite a central opening, with the non-planar end surface and the disk defining one or more channels between the mixing chamber and the interior of the shaft. (In other configurations, the shaft may have a planar end surface opposite the opening, and the shaft may have apertures formed therein.) In some embodiments, the disk includes a central opening, a plurality of partial annular openings through a planar surface of the disk, and projections extending into the mixing chamber. To exit the bottle, the fluid is advanced from the reservoir or body of the bottle through the openings in the disk (e.g., the partial annual openings or the central pinhole) and through the chute formed by the internal shaft and out the central opening of the base. The fluid is advanced through these openings and pathways by having a user apply manual pressure to the body of the bottle.

In some embodiments, the dispensing bottle includes a container body having a neck with external threads thereon that engage internal threads on a closure cap that includes a base and a flip-top lid. In one illustrative embodiment, the base of the closure cap has a skirt with base threads disposed thereon, where the base threads are configured to engage the external threads on the neck of the bottle. Further, in some embodiments, the base includes one or more retaining elements, projections, or rings on an internal surface of the base (such as on the internal surface of the skirt) and a central portion having an opening therein aligned with an internal shaft, where the opening permits the fluid to egress therethrough when the opening is unobstructed. By one approach, the internal shaft terminates at a non-planar end surface opposite the central portion. Further, this internal shaft may have a disk mounted adjacent thereto.

As noted, the cap has a flip-top lid, and in one illustrative configuration, the flip-top lid has an interior projection that is movable between a closed first position to an open second position, where the projection blocks the opening of the base, preventing or inhibiting egress of the fluid from inside the container body in the first position and, in the second position, permits egress of the fluid through the opening of the base. In addition, in one illustrative embodiment, a disk is attached to an interior of the base by snapping the disk into position at retaining ring(s), the disk having a central pinhole and partial annular slots disposed around the central pinhole. In one exemplary configuration, a mixing chamber is formed by the disk and the central portion of the base, along with the skirt and the internal shaft. Further, in some configurations multiple fluid channels are formed by the non-planar end surface of the internal shaft and the disk permitting fluid to flow from the mixing chamber into the internal shaft.

In some embodiments, the closure cap, in the closed position, is capable of maintaining the thixotropic fluid in stable equilibrium in the bottle without leakage when the bottle is in an inverted position such that the bottle opening is positioned below the body of the container. In some embodiments, when the closure cap is in the open position, during application of pressure to the container body, the configuration of the closure cap enables controlled dispensing of the thixotropic fluid, and release of pressure on the container body enables prompt cessation of dispensing, such as, for example, by permitting air to flow back into the container body to allow for spring back of the bottle and reversal of flow of thixotropic fluid in the interior channel. Further, in one illustrative configuration, this occurs without movement of the disk relative to the base. By one approach, the spring back is achieved by permitting air to be able to quickly enter the bottle to replace the volume of fluid that has been dispensed, which permits the bottle to quickly recover its original shape.

In one illustrative approach, at least a portion of fluid is dispensed by advancing downward through the partial annular openings, through the mixing chamber, then inward through the fluid channels defined between the disk and the nonplanar end of the internal shaft, then downward through the interior of the shaft before exiting the dispensing bottle via the central opening. By one approach, a thixotropic fluid disposed in the bottle can be squeezed from the bottle such that it advances through the partial annular slots in the disk, and through the mixing chamber where any separated serum can be mixed into the fluid before the thixotropic fluid moves through channels formed by an end of the internal shaft and the disk and out the central opening of the base. Further, a portion of the fluid also may advance downward through the small aperture or pinhole in the disk and through the central opening of the base. As suggested above, in operation, the bottle is able to quickly regain its shape upon cessation of pressure on the bottle. Air may flow into the bottle via one or both of these pathways, e.g., through the pinhole in the disk and/or through the annular openings, such that air is able to flow into the bottle through the internal chamber, channels, pinhole, mixing chamber, and/or partial annular slots. Generally, the air is pulled into the bottle when pressure is released on the body of the bottle or container. Thus, in short, the air is admitted into the main cavity of the bottle by flowing through at least one of the central pinhole or the partial annular slots of the disk. Further, once the disk is installed into the base of the closure cap, by one approach, the disk remains stationary relative to the base.

In some embodiments, the closure cap, including the base, flip-top, and disk are generally comprised of a polypropylene material, such that the entire closure cap is recyclable as a unit. In addition, without a silicon membrane, the strength of the closure in some embodiments does not significantly degrade over time, and there is little or no degradation of its performance over time. In some embodiments, there is little or no variation in the pressure required to dispense fluid from the bottle over the life of the bottle.

As described herein, the closure cap may permit better dosing. It may prevent accidental high velocity discharge of product from the bottle, which can be messy, and may prevent permanent collapse or other permanent inward deformation of the bottle. Further, the closure cap configuration may reduce splatter. Also, as described below, the mixing chamber may be configured to facilitate cleaning of its exterior surface, e.g., by having an outwardly convex or dome-shaped exterior surface.

By one approach, the outside, bottom (when the bottle is inverted) surface of the base, adjacent the central opening through which the fluid is dispensed, has an arcuate or dome-shaped central portion with a planar peripheral surface therearound. In one example, the inside of the base has the internal shaft extending at least somewhat parallel to the skirt of the base. In some configurations, the base includes an internal cut-off blade disposed adjacent the central opening, where an inner diameter of the internal shaft is sharply reduced. By one approach, the cut-off blade has an edge that is sharp, without a burr thereon. In some configurations, an inner diameter of the opening itself is different from the internal shaft wall. More particularly, in such a configuration, the diameter of the opening into the container is smaller than the diameter between the walls of the internal shaft, and this reduction in size and the relatively sharp edge therebetween helps facilitate reduction of the tailing formation of the product by partially retaining the product in the closure. Also, the surface tension and the size of the opening also can help reduce the tailing formation of the product as well. While this cut-off blade does not prevent product from flowing out of the opening in the closure cap, it reduces the amount released under certain pressures by slowing the flow. By one approach, the cut-off blade is relatively small compared with the diameter of the shaft and in some configurations the internal cut-off blade has a width of about 1 mm, while the diameter of the opening into the container itself is about 3 mm to about 7 mm. In another configuration, the opening has a diameter of about 3.5 mm to about 4.5 mm. In yet another embodiment, the opening has a diameter of about 4 mm and the diameter of the internal shaft is about 6 mm. Accordingly, the cut-off blade has a width of about 1 mm in some configurations.

While the cut-off blade assists with rapid cessation of fluid dispensing, upon release of pressure on the bottle, the disk (and its interface with the internal shaft) also reduces the pressure caused by the product in the bottle, which assists with cessation of dispensing. As discussed below, the size and configuration of the openings in the disk assist with flow monitoring and depending on the viscosity and surface tension of the product, and the geometry of the disk may be adjusted to accommodate different fluids.

At the upper end of the internal shaft, disposed away from the opening in the base, the internal shaft, in some embodiments, has a non-planar end surface. By one approach, the non-planar end surface has a stepped configuration creating a plurality of teeth and depressions. By another configuration, the non-planar end surface is configured with a wavy, sinusoidal or other arcuate depression.

As suggested above, the bottle and cap described herein may be employed for use with a wide variety of fluids. In one illustrative configuration, the bottle is filled with a thixotropic fluid, such as, for example, certain condiments, sauces, or certain consumer items, such as shampoo or body wash. Such applications may be particularly advantageous because they permit the consumer or user to easily and quickly dispense a desired amount of fluid without splattering or otherwise creating an unintended mess with the fluid. By one approach, the dispensing bottle with the closure cap may have a capacity of about 250 mL to about 1000 mL. Further, a variety of container configurations are contemplated, including some that are stored in an inverted configuration where the bottle rests on the closure cap. In one illustrative approach, the disk has a diameter of between about 20 to about 40 mm, the internal shaft has a height of between about 4 to about 12 mm, and the internal shaft has a diameter of about 3 to about 9 mm. In other configurations, the internal shaft has a height of about 5 to about 9 mm, with a diameter of about 3-5 mm.

As noted above, the closure cap has a mixing chamber formed by a portion of the base that has a disk secured thereto. By one approach, the mixing chamber includes a plurality of extensions therein from the disk. More particularly the disk, in some configurations includes a plurality of extensions of flanges that extend downward from the bottom of the disk (with the bottle inverted) into the mixing chamber. The mixing chamber described herein helps prevent serum from leaking from the dispensing bottle, in part, by mixing serum that has separated from the thixotropic fluid back into the remainder of thixotropic fluid. By one approach, the mixing chamber prevents separated serum from leaking from the bottle by mixing the separated serum back into the fluid before it leaves the opening of the bottle. In some embodiments, the mixing chamber has a capacity of, or retains, 2 mL to 11 mL, 3 mL to 9 mL, or 5 to 7 mL, or about 6 mL. The disk extensions may help with remixing of separated serum by slowing the flow of the fluid through the mixing chamber, creating or increasing turbulence, and/ or otherwise increasing interaction between separated serum and the remainder of the fluid.

By one approach, multiple retaining rings may be provided, and one of those rings may have a bottle or cap liner associated therewith that may seal the bottle after the closure cap is attached thereto. For example, a first retaining ring and a second retaining ring may be spaced axially (vertically) from each other with an edge of the disk captured therebetween. The upper ring (with the bottle inverted) may have a removable film or liner member associated therewith that seals against the opening at the neck of the bottle before use. Prior to dispensing product, the liner member may be manually removed by a consumer.

A bottle with a closure cap described herein may be formed, filled and sealed in high speed, high volume, mass production operations, or in other types of operations. In one approach, a method of manufacturing a dispensing bottle generally includes forming a squeezable, flexible bottle, e.g., by blow molding, injection molding, or other methods; forming a disk and a closure cap having a base and a flip-top lid by injection molding or other methods; snapping the disk into the base; filling the receptacle with a fluid (such as, for example, a thixotropic fluid); and securing the closure cap onto the filled receptacle. In some embodiments, the base has inner and outer skirts with base threads on the interior of the inner skirt (where the base threads are configured to engage the threads on the exterior of the bottle neck), a retaining ring on the interior of the inner skirt, and a central, dome-shaped portion having an opening therein aligned with an internal shaft terminating at a non-planar end surface opposite the central opening. The dome-shaped portion includes an opening permitting fluid to egress therethrough when the opening is unobstructed, and the flip-top lid has an interior projection that is movable between a first position and a second position, where the projection blocks the opening of the base inhibiting or preventing egress of the fluid when in the first position, and permits egress of the fluid through the opening of the base when in the second position. In some embodiments, the disk has a central pinhole, and partial annular slots disposed around the central pinhole, wherein the disk, the central portion of the base, the inner skirt, and the exterior surface of the internal shaft define a mixing chamber, and wherein multiple fluid channels are formed between the non-planar end surface of the internal shaft and the disk. In some configurations, the method also includes sealing the receptacle with a removable liner associated with the closure cap to seal the product in the body of the bottle. As discussed further below, the base and flip-top lid may be molded with the disk or separately therefrom.

In one illustrative configuration, a closure cap for a container includes a flip-top lid and base having, at least, a dome-shaped wall with an opening therethrough, an inner skirt, an outer skirt connected by an upper, planar portion, threads and one or more retaining rings on the inner skirt, and an internal shaft inwardly depending from the dome-shaped wall. By one approach, the internal shaft terminates at a non-planar end surface. Further, in such a configuration, the flip-top lid has a projection and is movable between a first position where the projection blocks the opening and a second position where the projection does not obstruct the opening of the base. The closure cap, in some configurations, has a disk attached to an interior of the base by snapping the disk into the retaining ring(s). In such a configuration, the disk has a central pinhole, partial annular slots disposed around the central pinhole, and flanges extending toward the base, the flanges disposed in between the internal shaft and the partial annular slots when the disk is attached to the base. Further, by one approach, the closure cap includes a mixing chamber defined by the disk, the dome-shaped wall, the inner skirt, and the internal shaft, wherein multiple fluid channels are formed by the non-planar end surface of the internal shaft and the disk.

In another approach, a method of manufacturing a closure cap includes forming, in a mold, a flip-top cap with (a) a base having, at least, a dome-shaped wall with an opening therethrough, an inner skirt, an outer skirt connected by a planar portions, threads and a retaining ring on the inner skirt, and an internal shaft inwardly depending from the dome-shaped wall, the internal shaft terminating at a non-planar end surface, and (b) a flip-top lid hingedly connected to the base, the flip-top lid having an interior projection and being movable from a first position where the interior projection blocks the opening to a second position where the interior projection does not obstruct the opening of the base. Further, in some approaches, the method also includes snapping a disk into the retaining ring of the base of the flip-top cap, the disk having a central pinhole, partial annular slots disposed around the central pinhole, and flanges extending toward the base, the flanges disposed in between the internal shaft and the partial annular slots when the disk is attached to the base. Further, in some embodiments, the disk and the base form a mixing chamber defined by the disk, the dome-shaped wall, the inner skirt, and the internal shaft, wherein multiple fluid channels are formed by the non-planar end surface of the internal shaft and the disk.

Further, in some configurations, the method also includes forming the closure cap as two separate components, including the flip-top cap and the disk, where the flip-top cap includes the base and flip-top lid formed in a single, integral, unitary, one-piece structure, and wherein the two separate components are made of the same material, and are assembled at the mold or at a separate station.

Figure 1B:
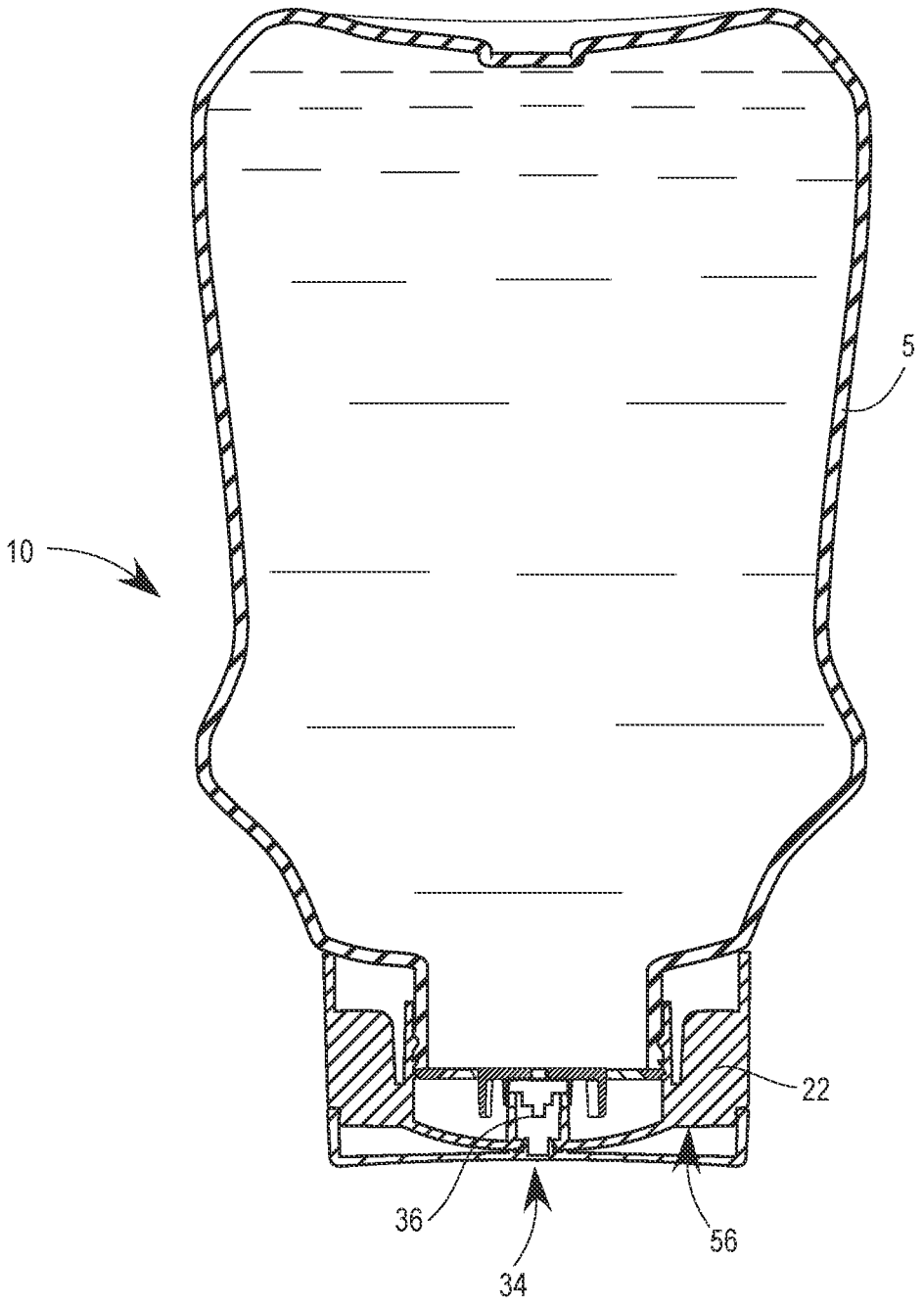
FIG. 1B is a cross sectional view of the bottle of FIG. 1A in an inverted position.

FIGS. 1A and 1B illustrate a packaged food product comprising a bottle 10 containing a fluid food product 5 such as ketchup, mayonnaise, barbecue sauce, mustard, or another product, with a closure cap 18 attached to a container body 12 via internal threads 32 (see, e.g., FIG. 4) of the closure cap 18 engaging external threads 16 of the container body 12. A portion of the closure cap 18 is shown transparently in FIG. 1A for illustrative purposes. While FIG. 1A shows the bottle in an upright position, in some embodiments, the bottle 10 is configured to be stored inverted while resting on its closure cap, such as that shown in FIG. 1B. Accordingly, during storage and dispensing, the bottle 10 may have the closure cap 18 positioned below the container body 12 of the bottle 10 without unintended leakage of the fluid 5 from the bottle 10.

Figure 2:
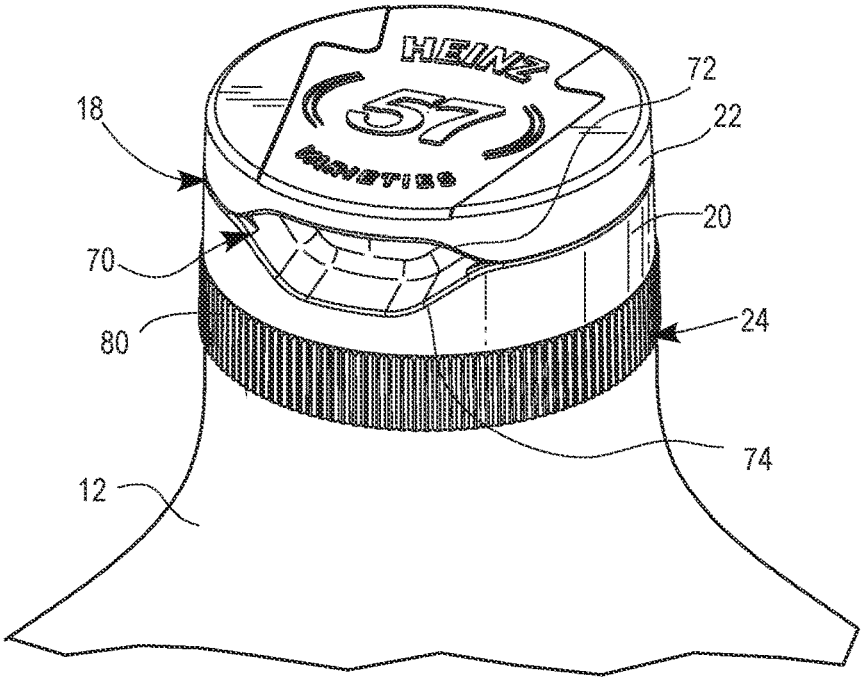
FIG. 2 is a perspective view of a cap and a portion of a bottle in accordance with several embodiments.
Figure 3:
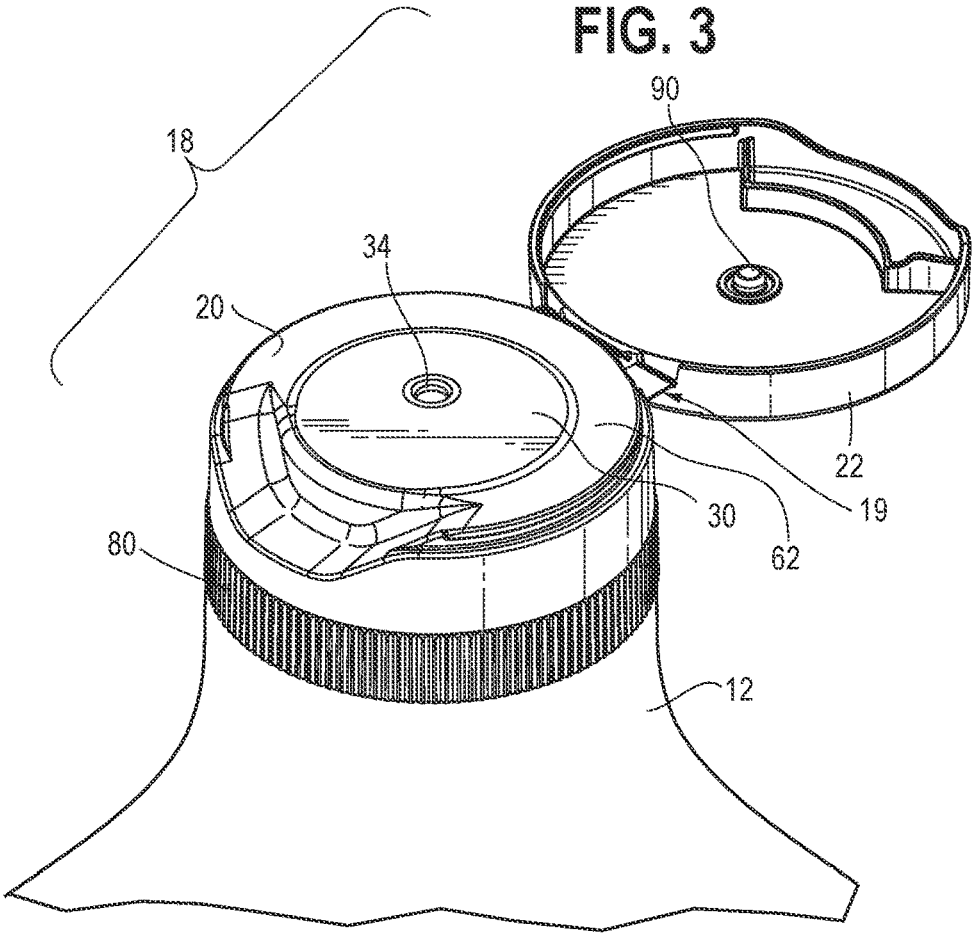
FIG. 3 is a perspective view of the cap of FIG. 2 in an open configuration.

The closure cap 18, as shown in FIGS. 2 and 3 includes a base 20 and a hinged or flip-top lid 22. To open the bottle 10 to permit the fluid 5 to be easily dispensed therefrom, a user may pivot the flip-top lid 22 from the closed configuration of FIG. 2 to the open configuration of FIG. 3. To that end, a user or consumer may apply upward force to the lid 22 by engaging the mouth-shaped indentation 70 defined by the upper surface 72 and a lower surface 74. By one approach, a user will manually grasp and pull upward on the upper surface 72 pulling it away from the base 20 and a remainder of the bottle 10. The flip-top lid 22 then pivots about a hinge 19 opposite the mouth-shaped indentation 70 to sit stably in the open configuration.

As can be seen in FIG. 3, when the flip-top lid 22 is in the open configuration, a projection 90 of the flip-top lid 22 is moved from obstructing or blocking an opening 34 in the base 20 to a position away therefrom such that the opening 34 is unobstructed. FIG. 3 also illustrates a central portion 30, which may be dome-shaped, through which the opening 34 extends, and a planar portion 62 disposed at least partially therearound. The lower surface 74 of the mouth-shaped indentation 70, as shown in the illustrative embodiment of FIG. 3, extends between sections of the planar portion 62.

Figure 4:
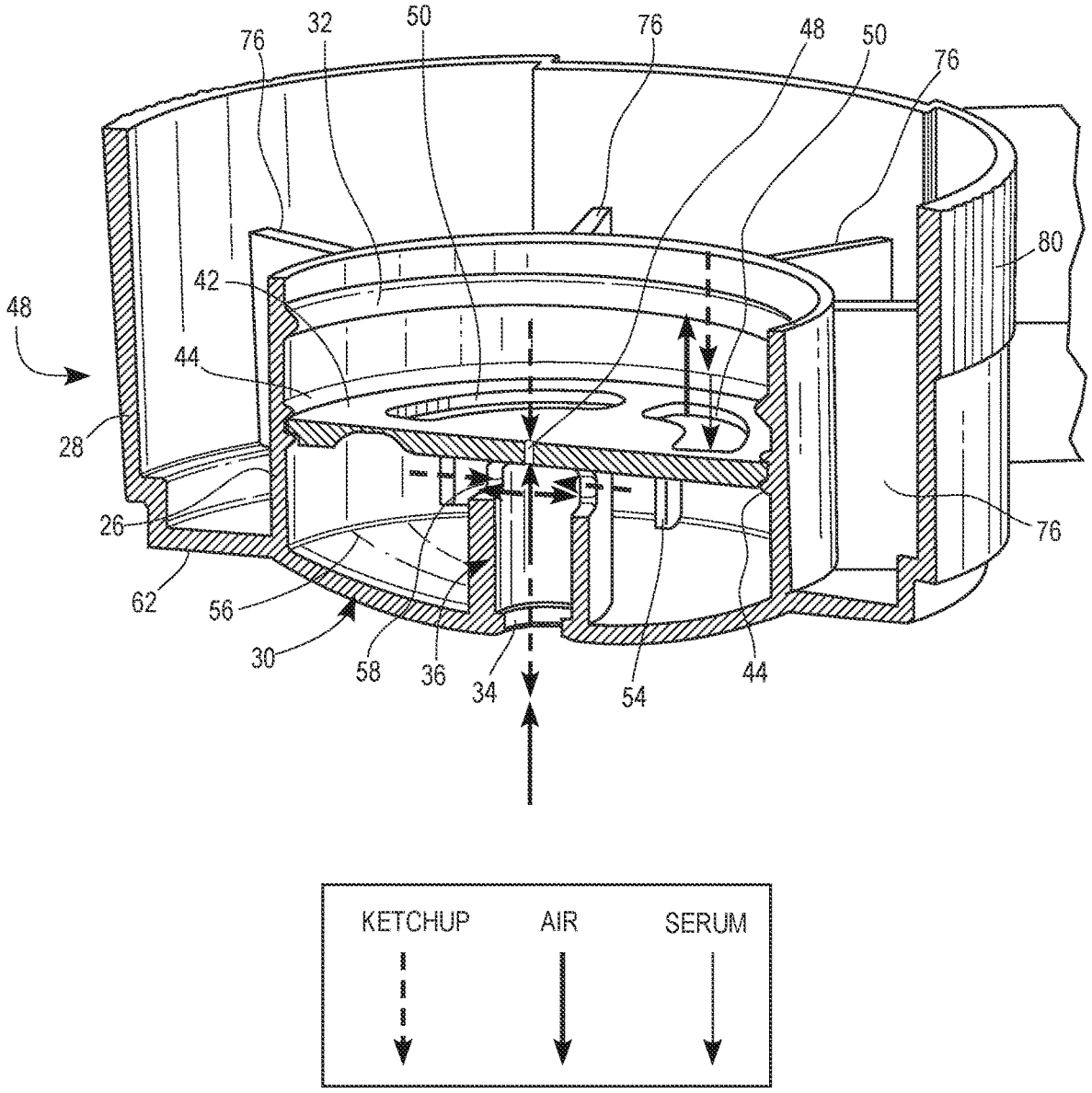
FIG. 4 is a perspective cross sectional view of a portion of a cap in an inverted orientation.

FIG. 4 illustrates a perspective cross-sectional view of a portion of the closure cap 18 in an inverted orientation. As shown in FIG. 4, the base 20 includes an inner skirt 26, upon which the internal threads 32 and one or more retaining rings 44 are disposed, an outer skirt 28, a planar portion 62 therebetween, and a dome-shaped central surface 30 having an opening 34 disposed therein. One or more radial stiffeners or strengthening ribs 76, shown in FIG. 4, are disposed between the outer skirt 28 and the inner skirt 26. As shown in the illustrative configuration of FIGS. 4 and 5, the base 20 includes an internal shaft 36 extending upward away from the central dome-shaped surface 30 and terminating at a non-linear surface 38 (as shown in FIG. 5).

In one illustrative embodiment, the closure cap 18 includes a disk 42 (shown in FIGS. 4 and 6) with a plurality of openings therein, through which the fluid 5 and air can flow. By one approach, the retaining rings 44 disposed on the inner wall of the inner skirt 26 capture the disk 42 therebetween. In another configuration (not shown), the disk 42 may be captured between a retaining ring and another structure, such as, for example, a portion or extension of the internal shaft 36. FIG. 4, illustrates a cross section of a portion of the closure cap 18 having the disk 42 snapped in between two retaining rings 44, illustrates how the disk 42 and the base 20 form a mixing chamber 56. In one illustrative embodiment, the mixing chamber 56 is formed by the walls of the inner skirt 26, the central portion 30, the internal shaft 36 of the base 20, and the disk 42.

Further, the planar portion 62 of the base 20 joins the inner skirt 26 and outer skirt 28 as well. As shown in FIG. 1, the base 20 also has ribs 80 disposed on the portion of the base 20 below (with the bottle in an upright orientation) the flip-top lid 22. These ribs provide a gripping surface such that if someone wanted to remove the entire closure cap 18 from the container body 12, the user is able to more easily grasp the closure cap 18 to disengage the internal threads 32 of the base 20 from the external threads 16 of the neck 14. In other configurations, the ribs 80 may be removed from the closure cap 18.

Figure 5:
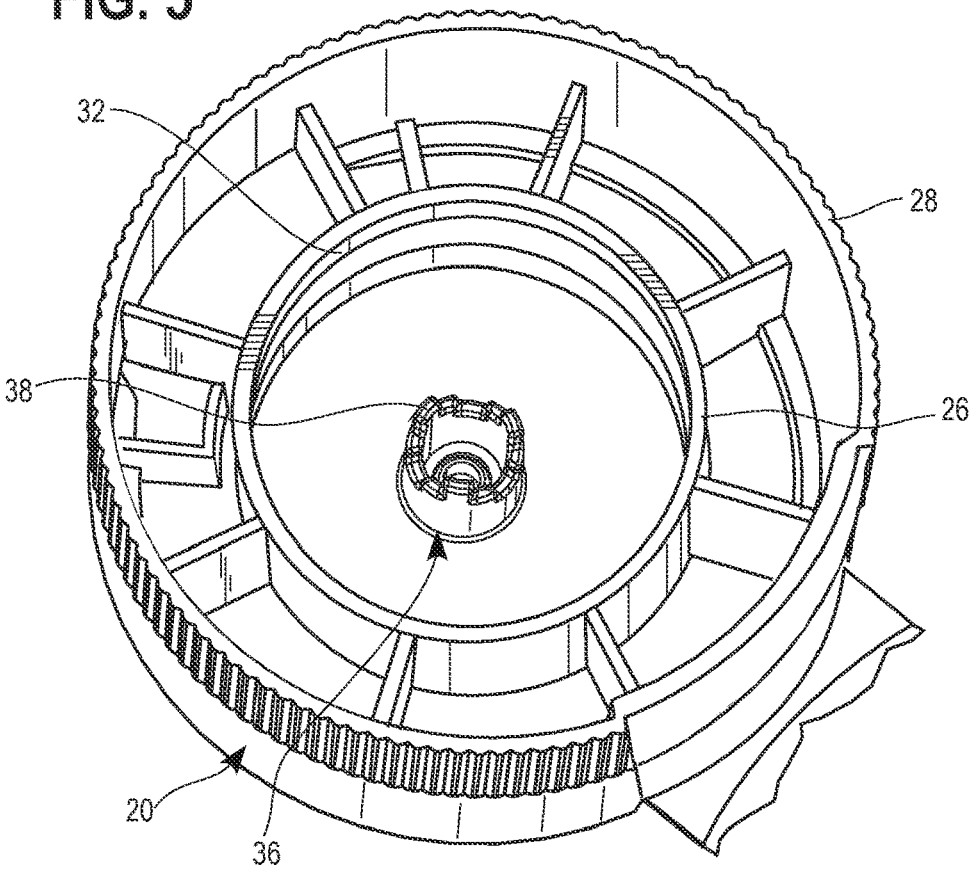
FIG. 5 is a perspective view of an underside of a portion of a cap with a disk removed therefrom in accordance with some embodiments.
Figure 8:
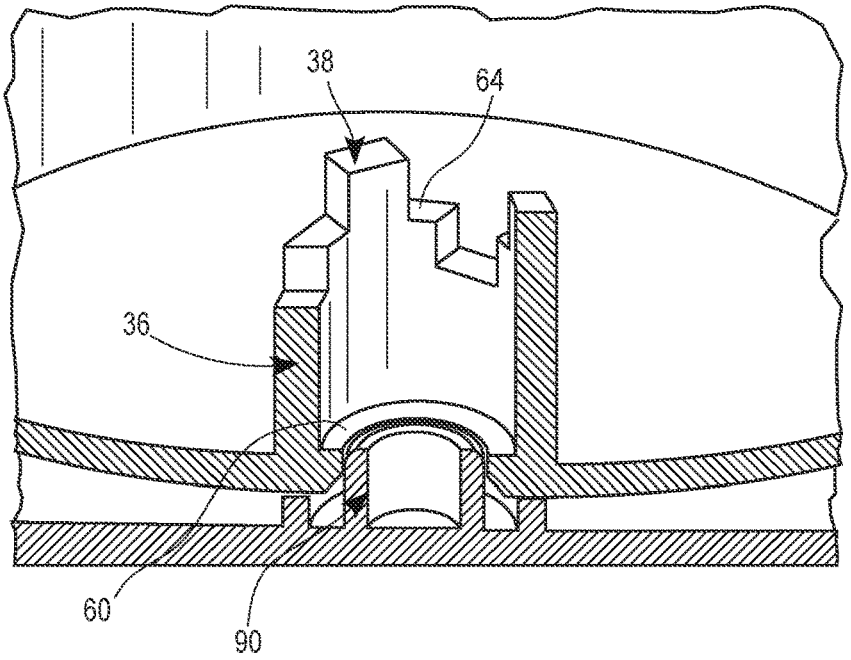
FIG. 8 is a perspective cross sectional partial view of the cap in a closed configuration with the disk removed therefrom in accordance with several embodiments.
Figure 9:
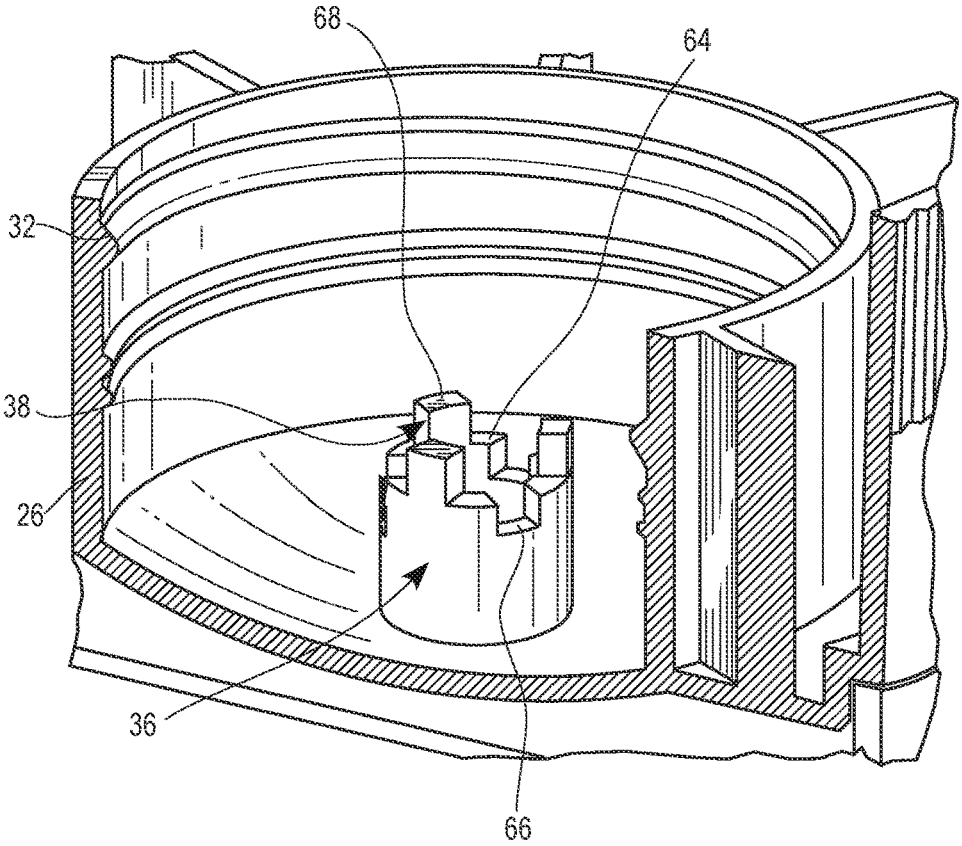
FIG. 9 is a perspective cross sectional view of a portion of the cap without the disk attached thereto in accordance with several embodiments.

FIGS. 5 and 9 illustrate one exemplary non-linear terminating surface 38 of the internal shaft 36 of the base 20. In some embodiments, the non-linear terminating surface 38 forms channel openings for both the fluid and air to travel between the mixing chamber 56 and the internal shaft 36. By one approach, the non-linear terminating surface 38 has a stepped configuration 64, as shown in FIGS. 8 and 9. In yet another approach, the non-linear terminating surface 38 has a wavy, sinusoidal or other arcuate configuration. In some configurations, the non-linear terminating surface 38 may have semi-circular depressions cut into the wall of the internal shaft 36. In addition, a single or a number of depressions may form one or more channels between the mixing chamber 56 and the internal shaft 36.

Figure 10:
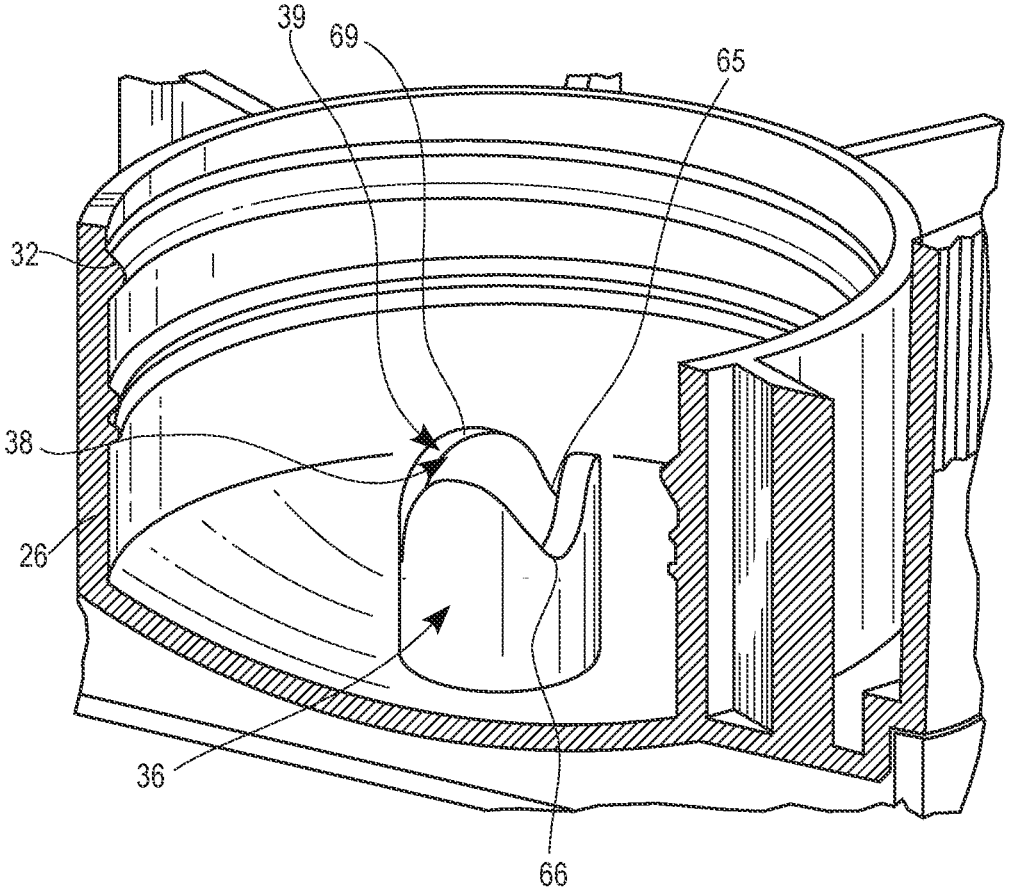
FIG. 10 is a perspective cross sectional view of a portion of the cap without the disk attached thereto in accordance with several embodiments.

Further, the stepped configuration 64, which is shown in FIGS. 5 and 9, may include one or more projecting teeth 68, and one or more deep slots 66 extending from a mid-point therebetween, or otherwise positioned. The stepped configuration 64 of the non-linear terminating surface 38 of the internal shaft 36 cooperates with the surface of the disk to form the fluid channels 58 having varying width and/or depth. As shown in FIG. 10, the non-linear terminating surface 39 also may have a wavy or an arcuate configuration with multiple slots or depressions 65 and rounded extensions 69. The wavy, non-linear terminating surface 39, which operates similar to the stepped configuration discussed above, forms channels 58 with the disk 42. In some configurations, the non-linear terminating surface may have a combination of stepped portions, projections, angles, and/or curved sections, among other elements.

Figure 39:
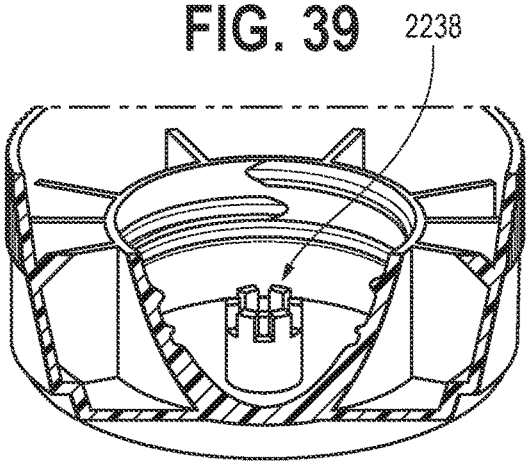
FIGS. 39-44 are partial perspective views having a portion removed therefrom illustrating alternative embodiments of the internal shaft of the base.
Figure 40:
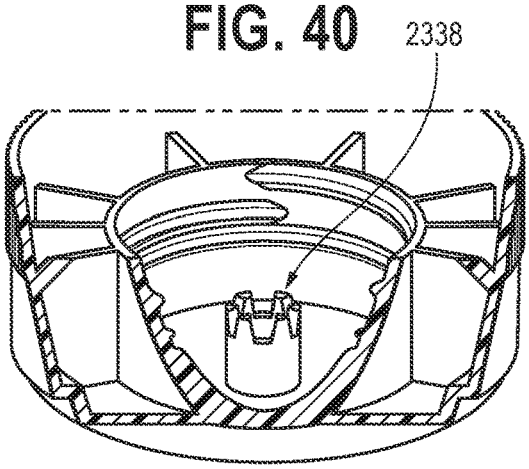
Figure 41:
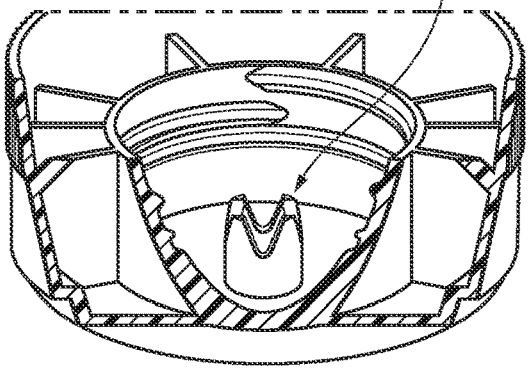
Figure 42:
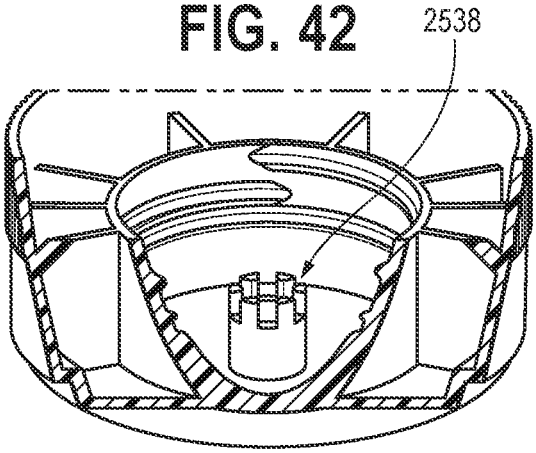
Figure 43:
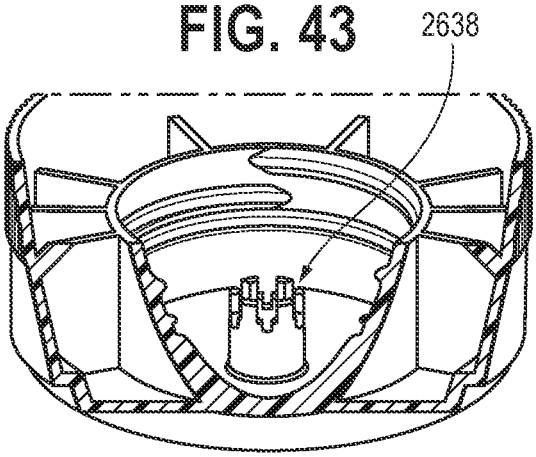
Figure 44:
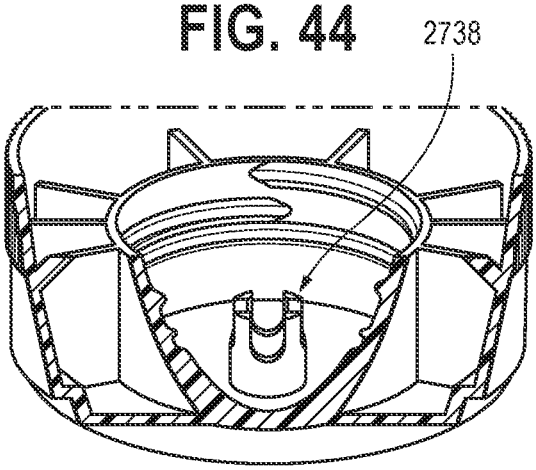

Indeed, the non-linear terminating surface 38 may take a variety of configurations, such as, for example, those illustrated in FIGS. 8-10 and 39-44. As discussed above, the non-linear terminating surface 38, shown in FIGS. 5 and 9, has a stepped configuration forming a number of channels 58. Further, in another configuration, the non-linear terminating surface 39, shown in FIG. 10, has a wavy or sinusoidal configuration. FIG. 39 illustrates a non-linear terminating surface 2238 that has two different heights, as opposed to the three different heights illustrated in FIGS. 8 and 9. FIG. 40 illustrates a non-linear terminating surface 2338 that has two heights and angled portions therebetween. FIG. 41 illustrates a non-liner terminating surface 2438 that has generally v-shaped valleys disposed in between prongs or projections having a triangular-shaped cross section. FIG. 42, similar to FIG. 39, illustrates a non-linear terminating surface 2538 having two different heights, but the prongs or projections of FIG. 42 have a triangular shape or a trapezoid shape with more acute or smaller angles adjacent the larger base. FIG. 43 illustrates a non-linear terminating surface 2638 having a stepped configuration, where the lowest step has a smaller width than the width of the uppermost step. Finally, FIG. 44 illustrates a non-linear terminating surface 2738 with triangular-shaped prongs or projections having u-shaped valleys therebetween. It is noted that the features illustrated may be used as shown or combined with other exemplary features including, for example, those shown in other figures. Alternatively, the end of the shaft may be linear or flat and the shaft may include other openings incorporated therein.

Figure 45A:
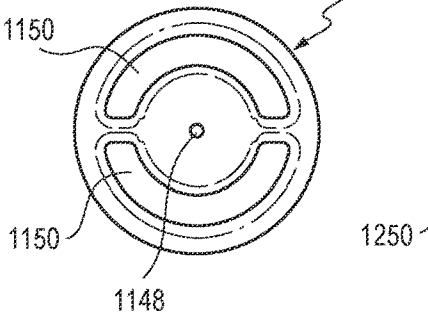
FIGS. 45A-45I are top plan views of alternative embodiments of the disk.
Figure 45B:
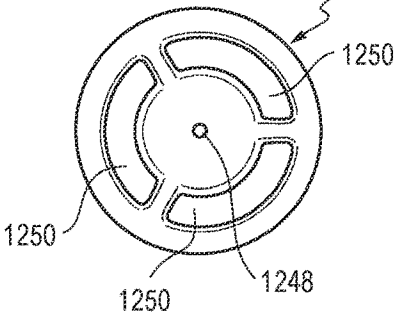
Figure 45C:
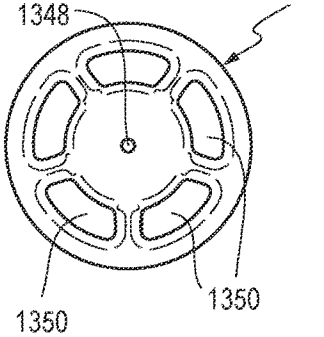
Figure 45D:
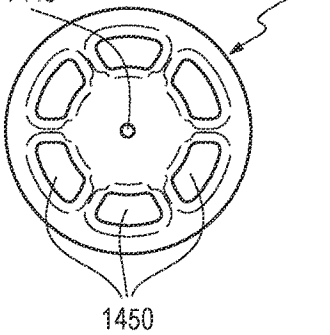
Figure 45E:
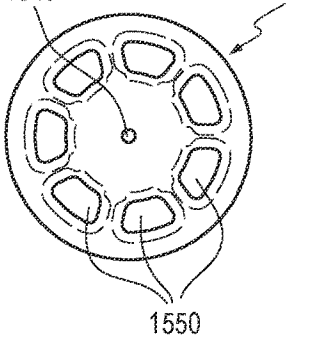
Figure 45F:
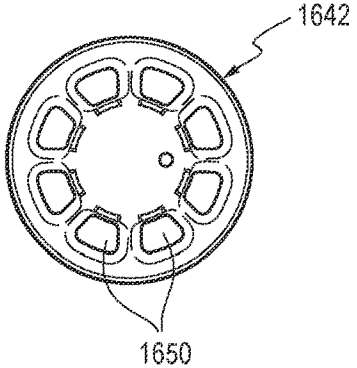
Figure 45G:
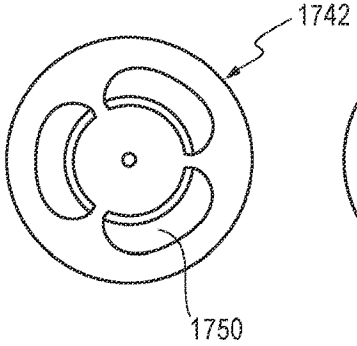
Figure 45H:
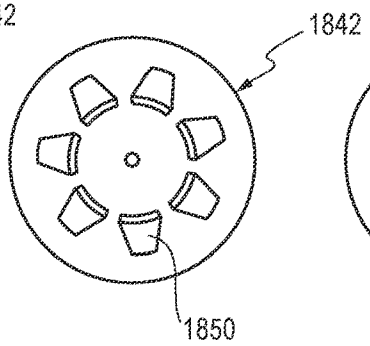
Figure 45I:
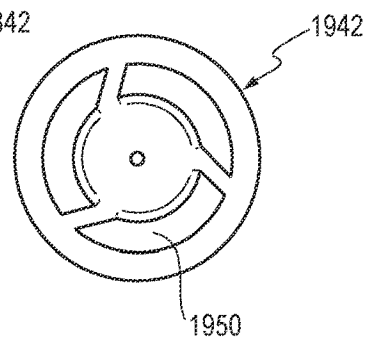

In addition to forming, in part, the mixing chamber 56, the disk 42 also defines annular partial slots or openings 50 therein to permit flow of fluid (and its constituent parts) into the mixing chamber. The annular openings 50 may take a variety of configurations, such as, for example, those illustrated in FIGS. 7A, 7B, and 45A-45I. By one approach, shown in FIGS. 7A and 7B, the disk 42 includes four openings. In another embodiment, shown in FIG. 45A, the disk 1142 has two openings. In another example, FIG. 45B includes three annular openings 1250, whereas the example of FIG. 45C includes five openings 1350. FIG. 45D illustrates an exemplary disk 1442 with six openings 1450, whereas FIG. 45E illustrates an exemplary disk 1542 with seven annular openings 1550. The exemplary disk 1642, shown in FIG. 45F, includes eight annular openings 1650 and an offset pinhole 1648, whereas the pinholes in FIGS. 45A-45E and 45G-45I are centrally disposed in the disks shown therein. Further, while the corners of the annular opening illustrated in FIGS. 7A, 7B, and 45A-45F are rounded, lacking any sharp edges or pinch points, FIGS. 45G-45I illustrate openings with less rounded openings 1750, 1850, and 1950. These features may be combined in a variety of manners.

FIGS. 47A-47I also illustrate a number of exemplary disks with a variety of features that may help manage the flow of the fluid from the bottle and through the cap. As mentioned above, the bottle is often stored and/or used in a top-down position, such that serum that separates in the chamber may leak from the bottle, in part, because it may not have a particularly long flow path or time with which to mix back into the fluid before advancing through being moved out of the bottle cap.

Figure 47A:
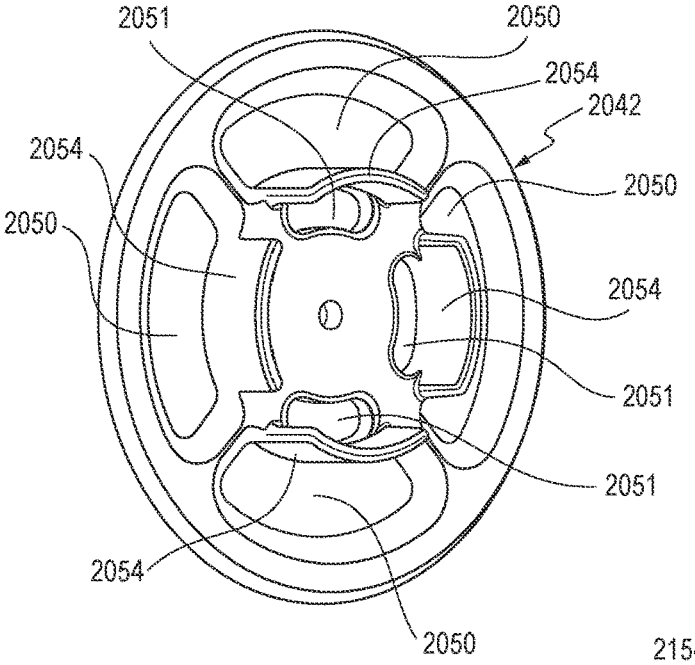
FIGS. 47A-47I are perspective views of an underside of alternative embodiments of the disk.
Figure 47B:
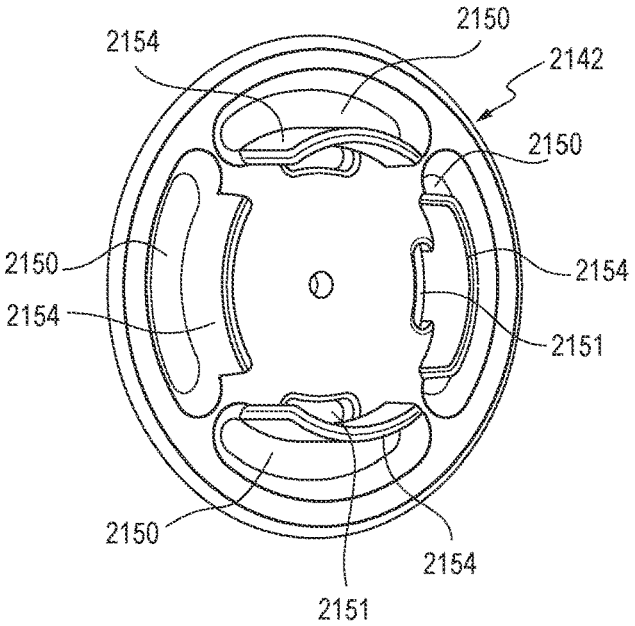
Figure 47C:
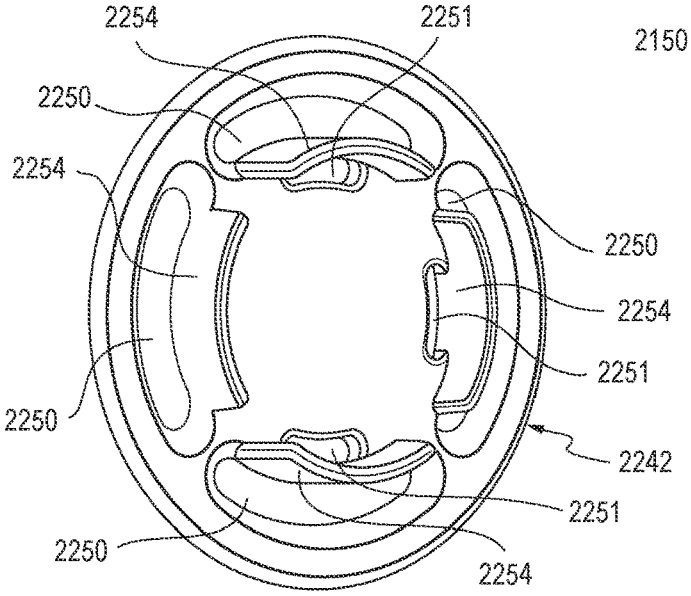

To facilitate the mixing of any separated serum with the remainder of the fluid, the disk may incorporate a number of additional features, such as, for example, additional openings disposed interior of the flanges thereof. In one illustrative embodiment, these openings are intermediate to the annular slots and the center of the disk, which may have central pinholes, as discussed above. One illustrative disk 2042, shown in FIG. 47A includes annular openings 2051 that are interior to the flanges 2054, which are themselves interior to the larger annular openings or slots 2050. In this manner, there are smaller, interior openings 2051 adjacent the inner wall of the flange 2054 that assist with mixing the fluid and any separated constituent elements thereof. FIGS. 47B and 47C similarly illustrate exemplary disks 2142, 2242 that have intermediate or interior openings 2151, 2251 adjacent flanges 2154, 2254 and annular opening or slots 2150, 2250, though the shape and size of the openings are differently configured as compared to FIG. 47A and to each other. In addition, FIG. 47C lacks a central pinhole, whereas FIGS. 47A and 47B include a central opening in the disks illustrated therein. In addition to these configurations, the pinhole also may be disposed offset from the geometric center of the disks as well, as previously suggested above.

Figure 47D:
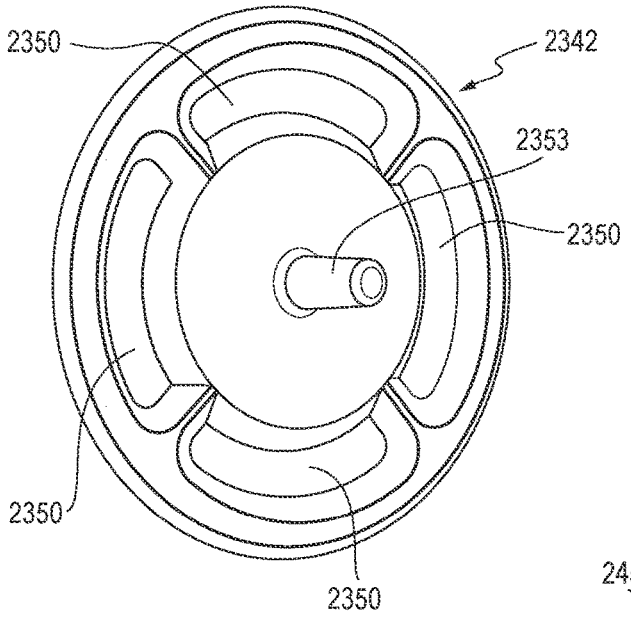
Figure 47E:
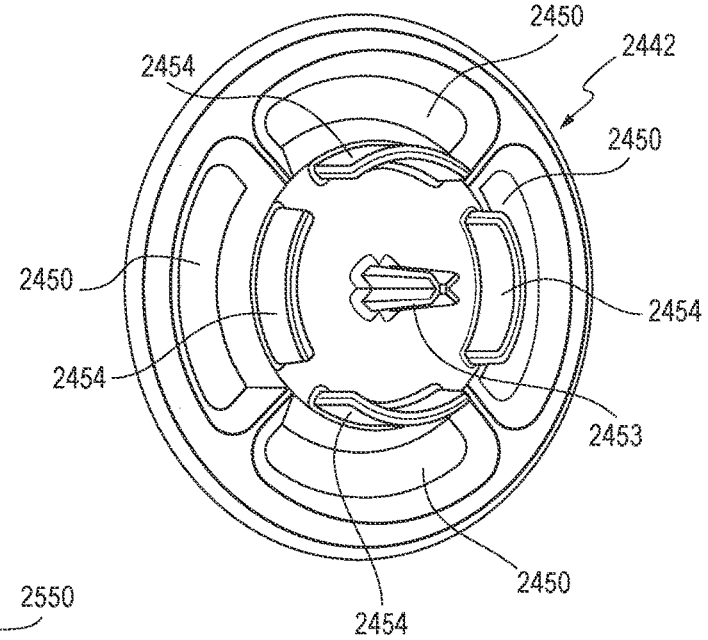
Figure 47F:
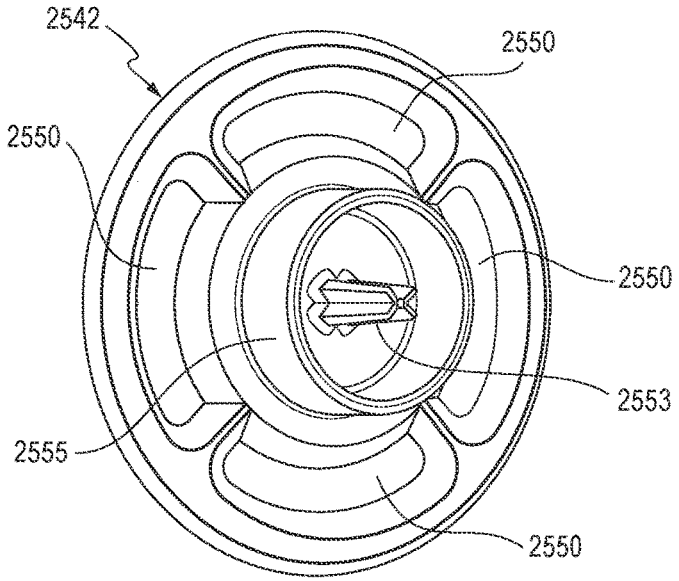

FIGS. 47D-47F illustrate additional illustrative embodiments of a disk with a post extending therefrom to facilitate mixing of the fluid as it moves through the cap. Once installed or secured to a remainder of the cap, the post typically extends toward the exit or opening of the bottle. For example, the exemplary disk 2342 (FIG. 47D) includes annular openings 2350 and a centrally disposed post 2353 having relatively smooth sides thereof. The illustrative disk 2442 illustrated in FIG. 47E includes annular openings 2450, flanges 2454, and a centrally disposed post 2453. Whereas post 2353 has relatively a rounded exterior, the post 2453 has uneven sides, with a cross section having a generally x-shaped configuration.

While the post is shown centrally disposed, it also may be disposed off-center and multiple posts may be incorporated into the disk. Further, the post may have a variety of surface textures and configurations. Indeed, depending on the fluid moving through the cap, a variety of differently configured posts may be incorporated into the cap.

Figure 47G:
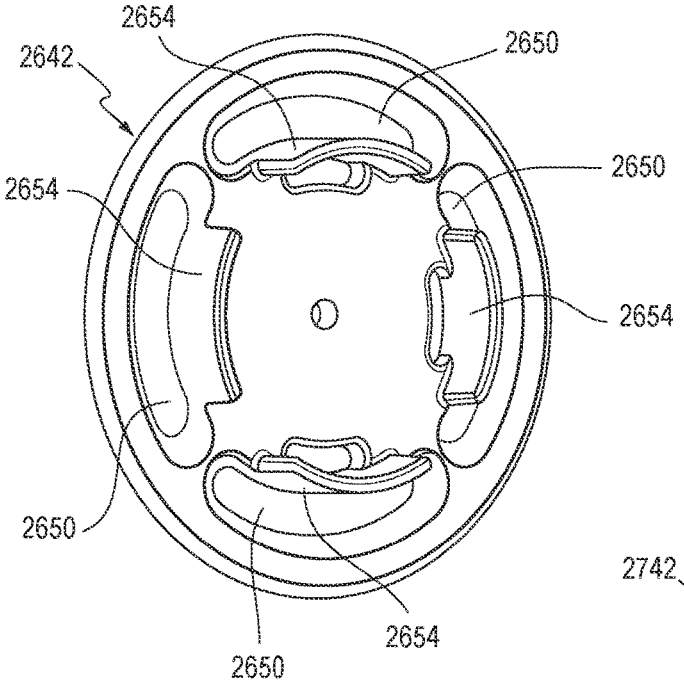
Figure 47H:
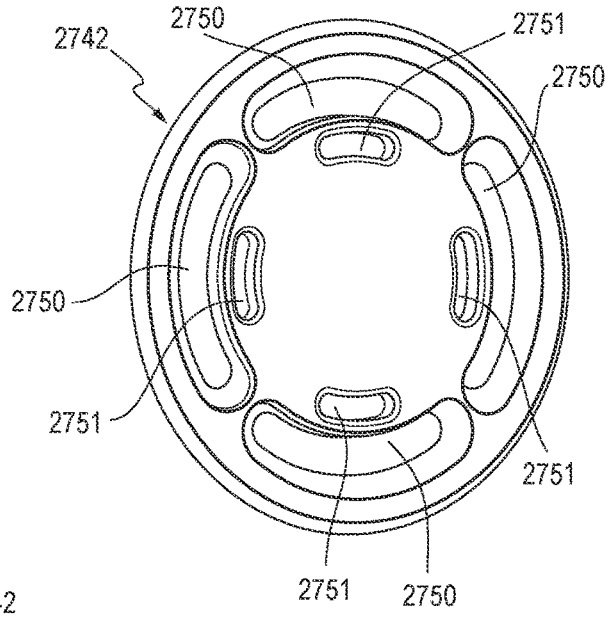
Figure 47I:
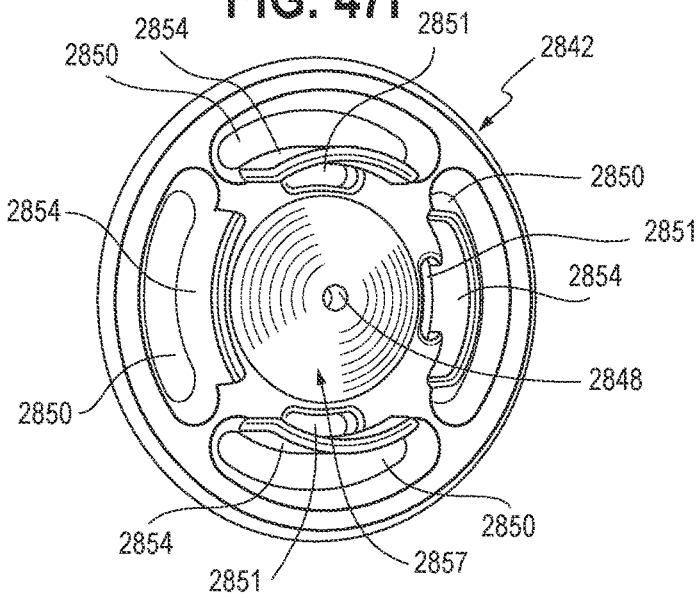

In some configurations, instead of a post, the disk may have another, similar structure such as a cone. FIG. 47I illustrates the central portion of a disk 2842 having a cone shaped extension 2857 with an opening 2848 extending therethrough. In addition, the disk 2842 also includes annular openings 2851, flanges 2854, and openings 2850.

Figure 46A:
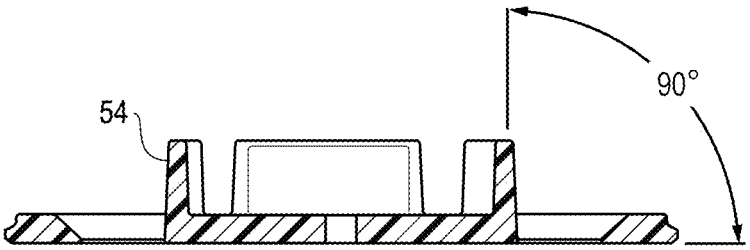
FIGS. 46A and 46B are cross sections of alternative embodiments of the disk.
Figure 46B:
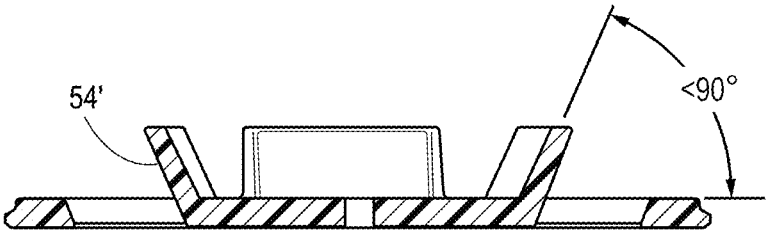

The disk 2542 of FIG. 47F, similarly has a centrally disposed post 2553 with a generally x-shaped cross section and annular openings 2550. Instead of discrete flanges, however, the disk 2542 has one continuous flange or a cylindrical wall 2555 extending from the disk 2542. While the cylindrical wall 2555 is illustrated generally perpendicular to the disk, it also may extend from the disk at an angle, similar to how the flanges illustrated in FIG. 46B are not perpendicular.

Figure 48:
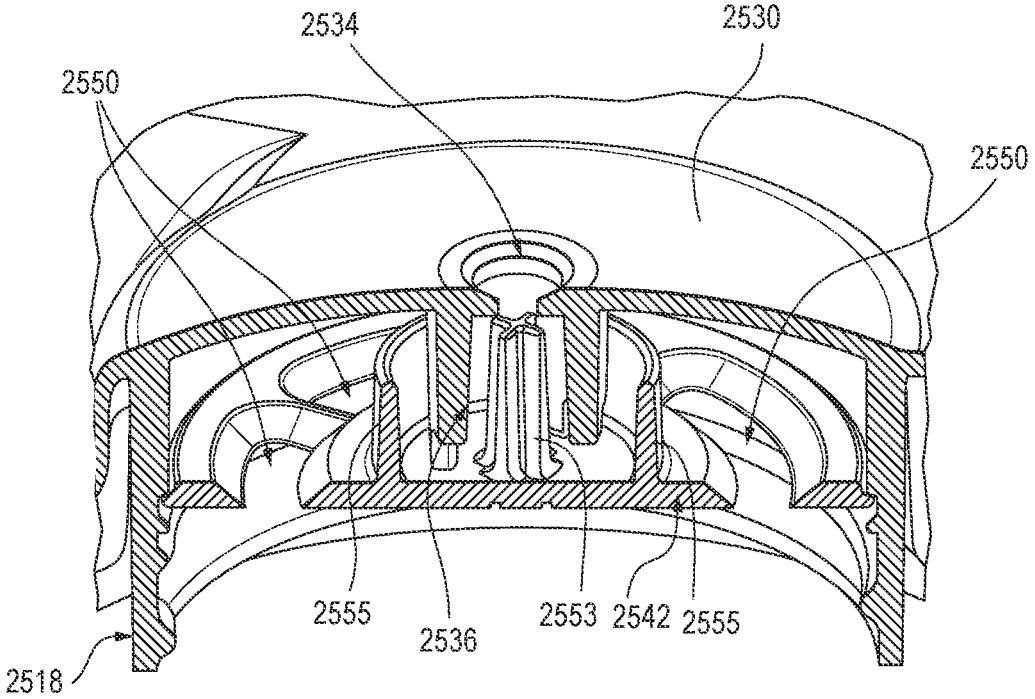
FIG. 48 is a partial cross sectional view of a portion of an alternative cap in accordance with several embodiments.

FIG. 48 illustrates the disk 2542 secured to a remainder of the closure cap 2518. Furthermore, the post 2553 is illustrated as extending at least partially into internal shaft 2536. In this manner, the fluid must advance through annular openings 2550, over or around the cylindrical wall 2555, over or around the end of the internal shaft 2536 and through the shaft, along the post 2553 to the opening 2534. Such configurations, having a somewhat winding flowpath, may be particularly suited for certain fluids with particular fluid properties.

Other modifications or combinations of the features described herein may be made. For example, FIG. 47G illustrates a disk 2642 that is similar to the disk 2142 of FIG. 47B, however, flanges 2654 are not as long as those illustrated in FIG. 47B such that the fluid has more room or space to move between the flanges 2654 of FIG. 47G, as compared to those in FIG. 47B. In addition, FIG. 47H illustrates a disk 2742 having outer annular openings 2750 adjacent openings 2751 without flanges disposed therebetween. Many of the various structural features of the disks may be combined or modified in a variety of manners, including those described herein, to tailor the disk to accommodate the properties of the fluid advancing from the bottle through the cap thereof.

As noted above, the mixing chamber 56 and the openings formed in the disk 42 by the disk 42 and the internal shaft 36 permit accurate dispensing and dosing of the fluid 5 within the container. Accordingly, the geometry of the disk 42 helps facilitate the proper dispensing of the fluid 5.

Figure 7A:
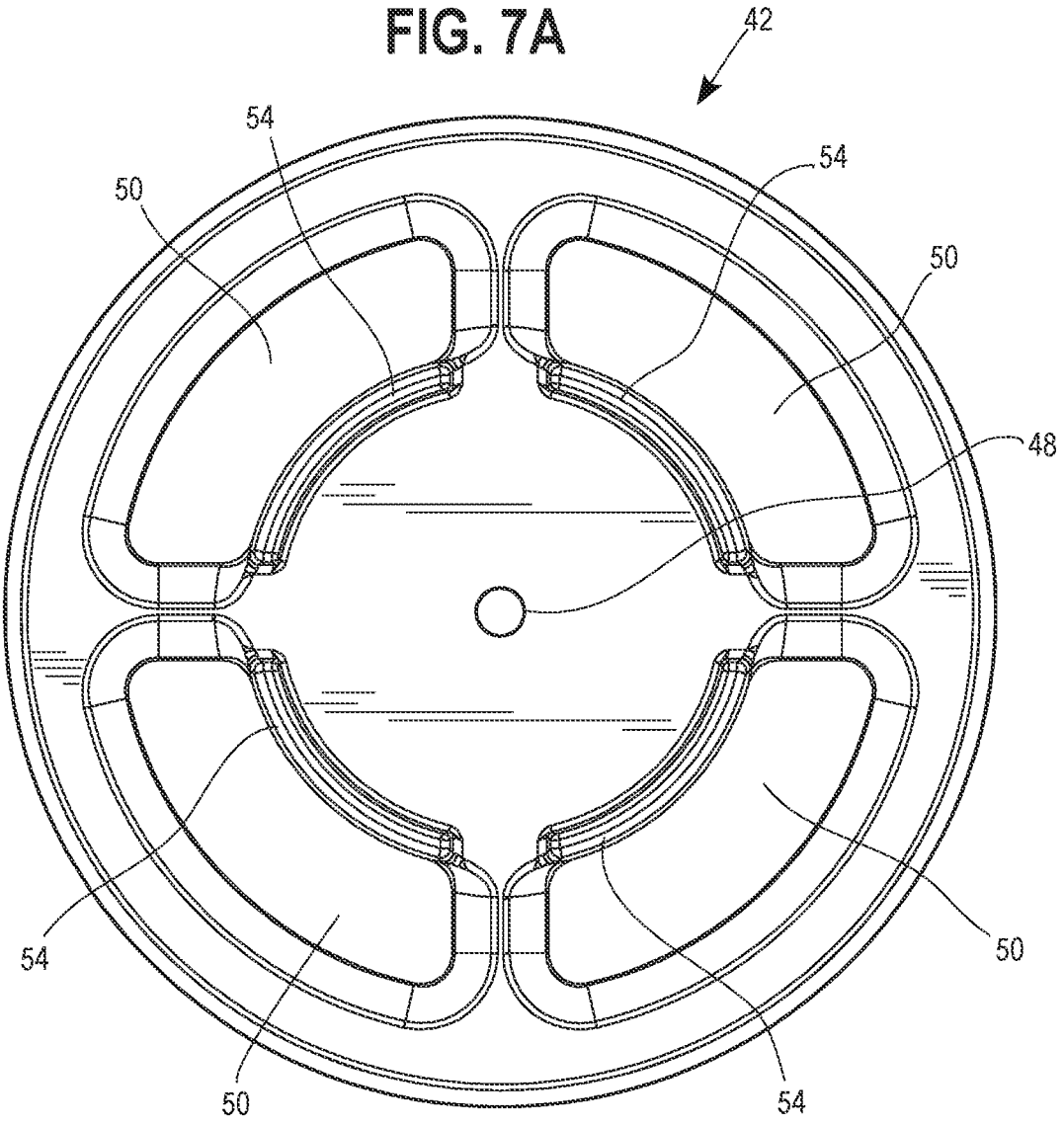
FIGS. 7A and 7B are top and bottom plan views of the disk in accordance with several embodiments.
Figure 7B:
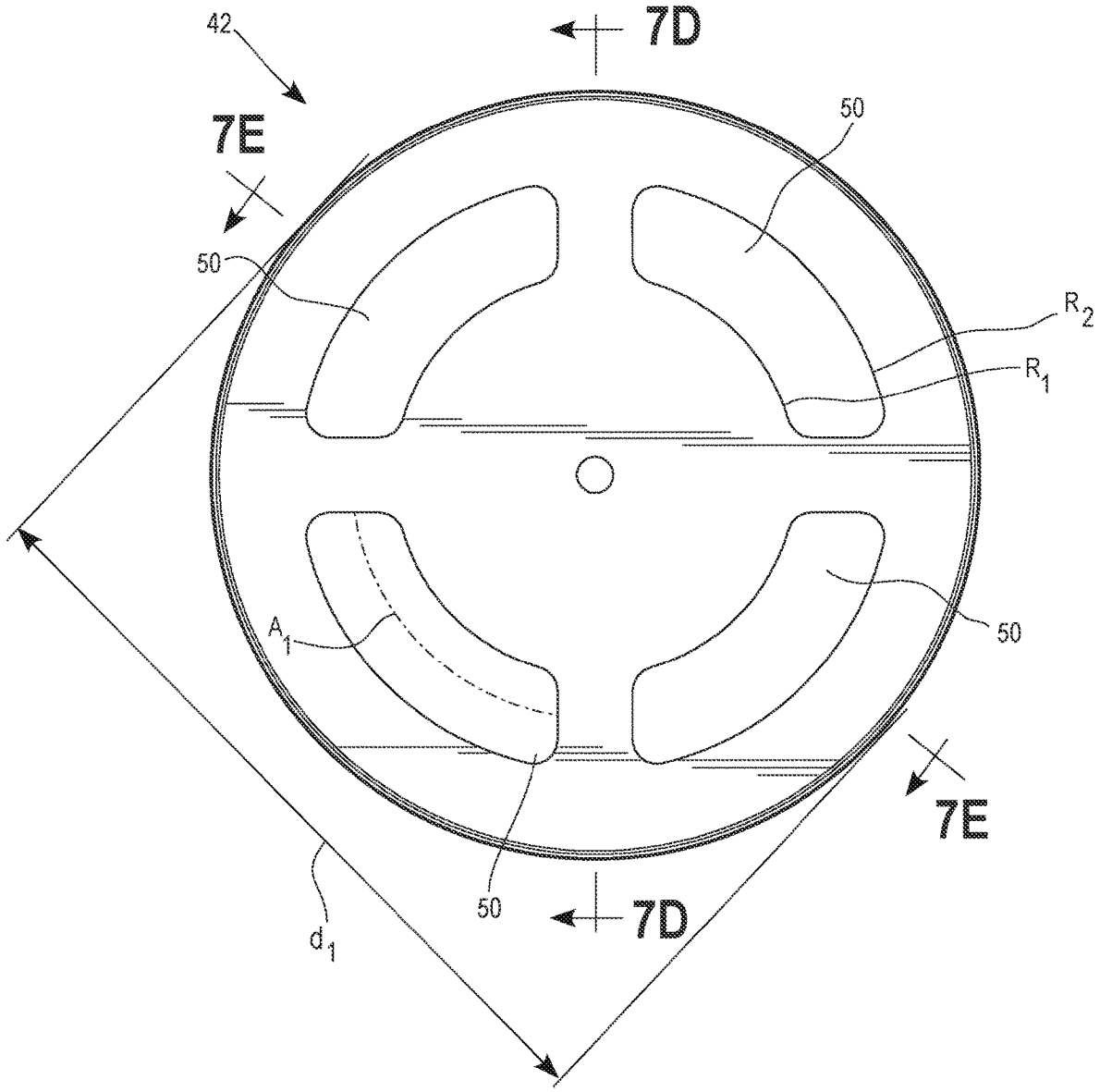
Figure 7C:
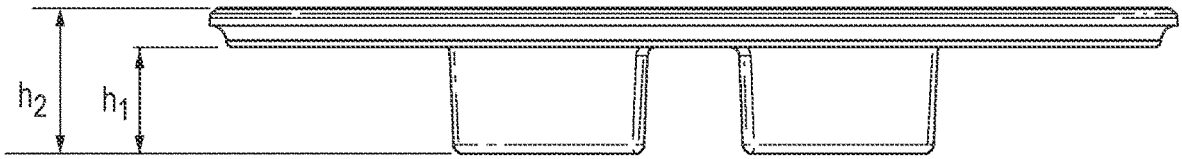
FIG. 7C is an elevational side view of the disk of FIGS. 7A and 7B.
Figure 7D:
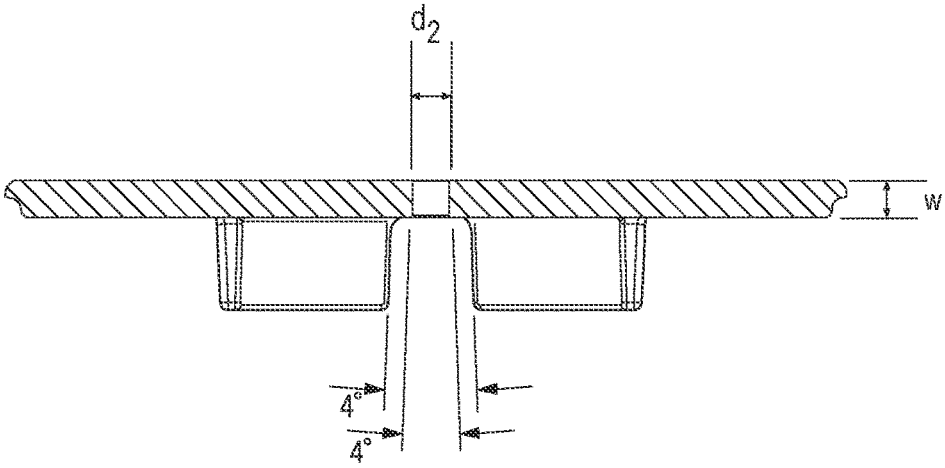
FIG. 7D is a cross section along line 7D-7D of FIG. 7B.
Figure 7E:
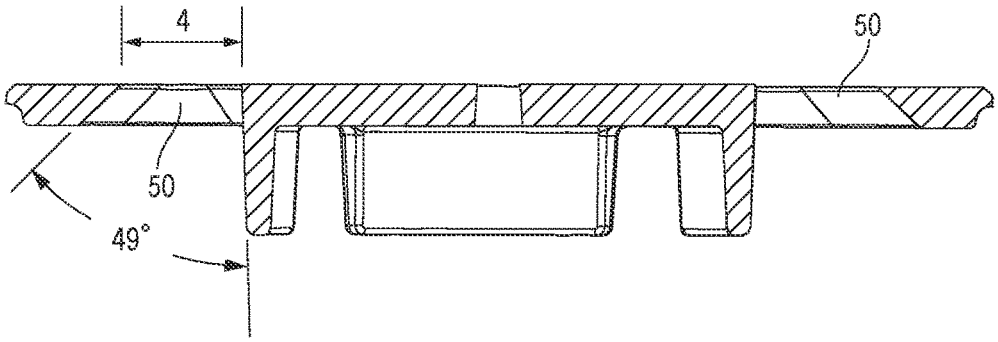
FIG. 7E is a cross section along line 7E-7E of FIG. 7B.

FIG. 7A illustrates a first side of the disk 42 which has flanges 54 extending downward therefrom when the bottle is inverted, and which faces the internal shaft 36 when the disk 42 is mounted in position between the retaining ring(s) of the closure cap 18. While the flanges 54 may extend orthogonally from a face of the disk 42 (as shown in FIGS. 7C-7E), the flanges 54 also may extend from the disk 42 at an angle besides 90°. Turning briefly to FIGS. 46A and 46B, two illustrative flange configurations are illustrated. FIG. 46A illustrates the flanges 54 extending about 90° from the body of the disk 42, whereas in FIG. 46B the flanges 54' extend less than 90° from the body of the disk 42. Such an angled flange may impact the flow of the product 5 entering the mixing chamber 56 and may influence the mixing action in the chamber. While both the flanges shown in both FIGS. 46A and 46B help mix the product as it advances toward the exit, depending on the fluid characteristics of the product, the angle of the flange 54', as shown in FIG. 46B may be smaller than 90°. As mentioned above, the central pinhole 48, which is centrally disposed through a planar portion of the disk 42, is partially surrounded by a plurality of slots or partial annular openings 50. The peripheral, partial annular openings 50 are significantly larger than the central pinhole, and a majority of the fluid 5 exiting the bottle 10 advances through the partial annular openings 50. In some embodiments, the disk 42 has a diameter, $D_1$, of 20 mm to 40 mm, 25 mm-35 mm or about 30-34 mm. In one illustrative configuration, the disk 42 has a diameter, $D_1$, of about 31.9 mm±0.1 mm. By one approach, the annular slots have an arcuate length of 10-15 mm, or 11-14 mm. As shown in FIG. 7B, the arcuate length $A_1$, of each of the openings may be about 12.7 mm. Further, the annular openings 50 have an inner radius of curvature $R_1$ on the inner edge of the opening and an outer radius of curvature $R_2$ on the outer edge of the opening. In one illustrative approach, $R_1$ is about 6-10 mm and $R_2$ is about 10-15 mm. In another illustrative approach, $R_1$ is about 8-9 mm and $R_2$ is about 12-13 mm. In one exemplary embodiment, $R_1$ is about 8.3 mm and $R_2$ is about 12.3 mm.

Figure 6:
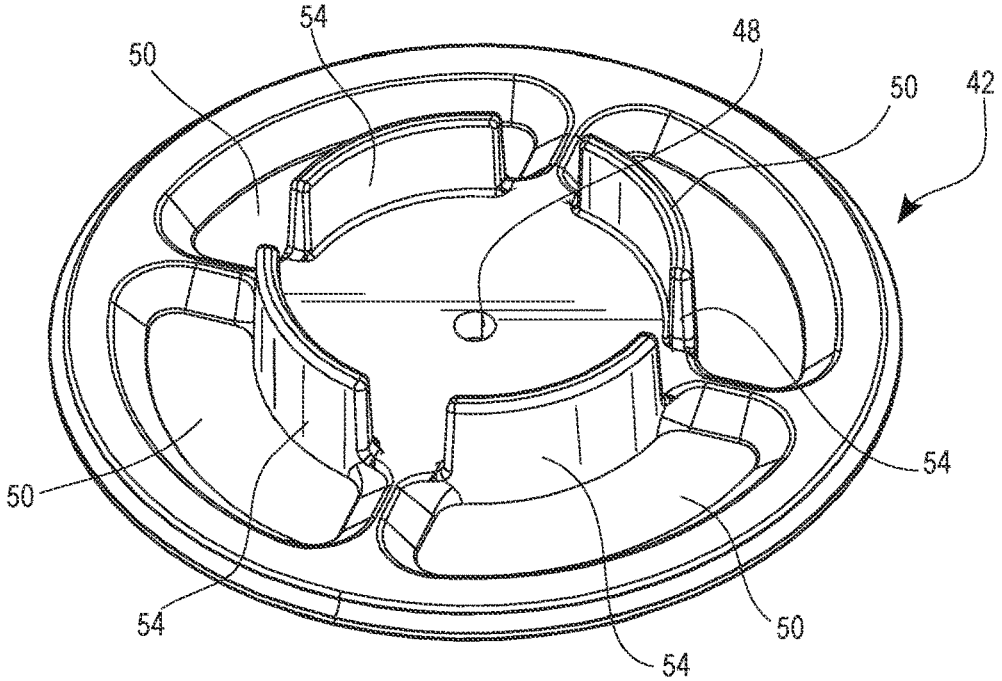
FIG. 6 is a perspective view of an underside of a disk in accordance with several embodiments.

As shown in FIGS. 6 and 7A, the partial annular openings 50 are disposed adjacent flanges 54, which, when the disk 42 is installed in the base 20, extend into the mixing chamber 56 such that the fluid 5 (including any constituent parts, such as serum) cannot advance directly through the openings 50 and into the internal shaft 36 to exit the bottle, but instead, the portion of fluid 5 that advances through openings 50 must flow into the mixing chamber 56 (thereby promoting the mixing of any constituent parts of the fluid 5 that have separated therefrom) before the fluid exits the bottle 10. In one illustrative approach, the extensions or flanges 54 have a height, $h_1$ that is about 2-5 mm. In another illustrative approach, the height $h_1$ is about 3-4 mm. In one exemplary embodiment, $h_1$, is about 3.5 mm. Further, in operation, the length or height of the flanges 54 may be linked to the depth of the channels 58 formed by the non-linear terminating surface 38 because having them similarly sized helps facilitate mixing by requiring that the fluid flow around the flanges 54 and not directly through the annular openings 50 and through the fluid channels 58. In one illustrative approach, the height of the disk 42, $h_2$, is about 3-7 mm. In another illustrative approach, the height of the disk 42, $h_2$ is about 4-6 mm. In yet another approach, the height of the disk 42, $h_2$, is about 4.8 mm.

The width, $w_1$, of the planar portion of the disk 42, as shown in FIG. 7D, in some embodiments is between about 0.75 mm to about 3 mm. In one illustrative approach, the width of the disk 42, $w_1$, is about 1-2 mm. In one exemplary approach, the width of the disk 42, $w_1$, is about 1.3 mm. The width of the central pinhole opening 48, as shown in, FIG. 2 as $d_2$, is about 1-2 mm. In one exemplary approach, the width of the pinhole 48, $d_2$ is about 1.5 mm.

As shown in FIG. 7E, each of the partial annular openings 50 may have a beveled edge on a surface of the disk 42 facing the base 20. This orientation may facilitate flow of fluid 5 (e.g., at least a portion of the fluid not retained in the internal shaft 36) back into the container body 12 when the bottle is placed in the cap-side up (upright) configuration. Further, the beveled edge also may facilitate moving the air back into the bottle to improve spring-back of the bottle or container body 12.

To facilitate proper dispensing of the fluid, the geometry of the disk 42 regulates the flow of the fluid 5 including for example, the size, shape, and angle of the flanges 54. In addition to the geometry discussed above, the disk 42 has sufficient openings therein relative to the area of the disk 42 to facilitate sufficient flow of the fluid 5, while nonetheless preventing leakage from the closure cap 18. The openings 50 are of a particular size, shape, and position to facilitate fluid flow that permits easy dispensing and quick spring back of the bottle. In one illustrative approach, the entire area of the disk is about 800 $mm^2$ and the aggregate area of the partial annular openings 50 and the central pinhole is about 211 $mm^2$ of that total area, or about 26% of the total area of the disk. By some approaches, the aggregate area of the openings of the disk will cover about 20-35% of the total disk area, and generally the partial annular openings comprise much more of this area than the central pinhole.

In FIG. 4, flow of ketchup during dispensing is shown as a dashed line. Flow of air into the bottle to replace ketchup after dispensing is shown as a heavy solid line. A lighter solid line illustrates flow of serum that has separated from the fluid 5, into the mixing chamber 56 where it mixes back into the fluid 5.

In some illustrative approaches, the closure cap 18 (e.g., the base 20, the flip-top lid 22, and the disk 42) is comprised of a single material, such as, for example, a polypropylene or other food grade plastic or polymer, or similar recyclable material. In operation, having the closure cap 18 formed of a single material may increase the ease and likelihood of recycling the material. By some approaches, the material may be chosen with a specific surface tension. For example, the disk 42 surfaces (and potentially other internal surfaces of the closure cap) may be rougher or textured to provide flow resistance and help control the flow of the fluid being dispensed. As discussed further below, the interior surface of the internal shaft 38 also may be textured to inhibit flow or may have a smooth surface to facilitate movement of the fluid therethrough. A smooth surface may result in faster and/or less controlled fluid flow, and due to a reduction in surface tension, may also lead to leakage of the product or a separated component of the product. The finish of the material or the manner in which the element was formed also may impact the surface tension of the elements and help facilitate control of the fluid flow. For example, some portion of the flip-top cap 18 may be formed in such a manner as to create a rough surface that might impact the flow of the fluid 5 passing therethrough.

Figure 38:
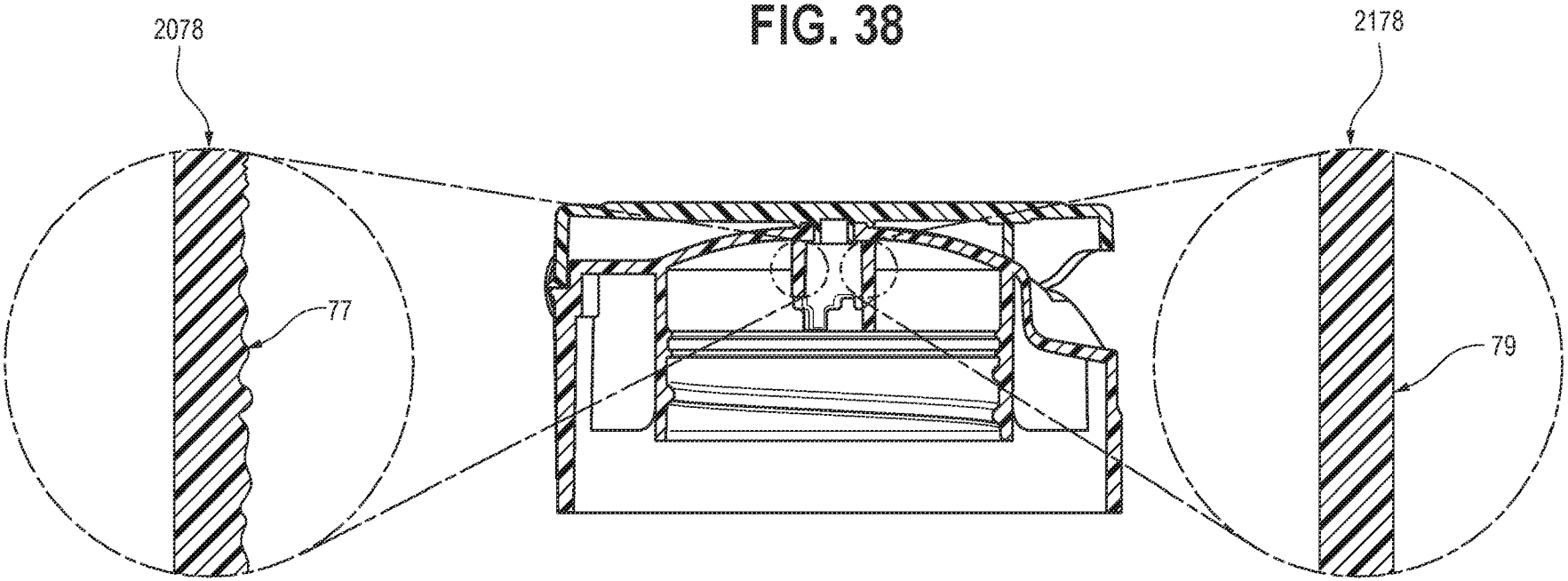
FIG. 38 is a cross section of a cap having detailed portions magnified to show various finishing options for the internal shaft.

Turning briefly to FIG. 38, two different exemplary finishes 77 and 79 are illustrated. While a single interior wall 78 may have the entire surface thereof with a single texture or portions of the surface with different textures, the cap 18 illustrated in FIG. 38 has a first portion 2078 with a rougher texture 77 and a second portion 2178 with a smoother texture 79. As noted above, the surface of the material forming the cap 18 may inhibit, slow, or restrict flow of the fluid 5 within the bottle. Whether or not to include a textured surface on portions of or the entire cap, such as, for example, the inner wall of the internal shaft, may depend on the type of fluid being advanced through the cap 18.

As shown in FIG. 6, a first side of the disk 42 (which is disposed adjacent the internal shaft 36 of the base 20 when installed) includes rainbow-shaped or arcuate flanges or extensions 54 that extend therefrom. When the disk 42 is mounted in the base 20, the arcuate flanges or extensions 54 extend into the mixing chamber 56 and toward the base 20. The disk extensions 54 facilitate mixing of the fluid 5 in the mixing chamber 56 by requiring that the fluid 5 move around the extensions 54 and not directly into the fluid channels 58 from the partial annular openings 50.

As shown in FIG. 8, the base 20 at the opening 34 and the internal shaft 36 has an internal cut-off blade or ledge 60 on an inside surface adjacent the opening where the inner diameter of the internal shaft is sharply reduced. For example, the diameter of the internal shaft may decrease sharply at the ledge 60 such that the sharp edge helps to facilitate reduction of the tailing formation of the product by partially retaining the product in the closure until the manual pressure on the container body becomes significant enough to overcome the tendency of the fluid to be retained in the closure cap by the ledge. By one approach, the cut-off blade has a sharp edge without a burr thereon. In some configurations, the diameter of the opening into the container is smaller than the diameter of the internal shaft, and this reduction in size and the relatively sharp edge therebetween assist with cessation of dispensing in a quick and clean manner. While this cut-off blade does not prevent product from flowing out of the opening in the closure cap, it reduces the amount released under certain pressures by slowing the flow. By one approach, the cut-off blade is relatively small compared with the diameter of the shaft, while the opening into the container itself is between about 3.5 mm to about 4.5 mm, and in one illustrative embodiment, is about 4 mm.

Figure 11:
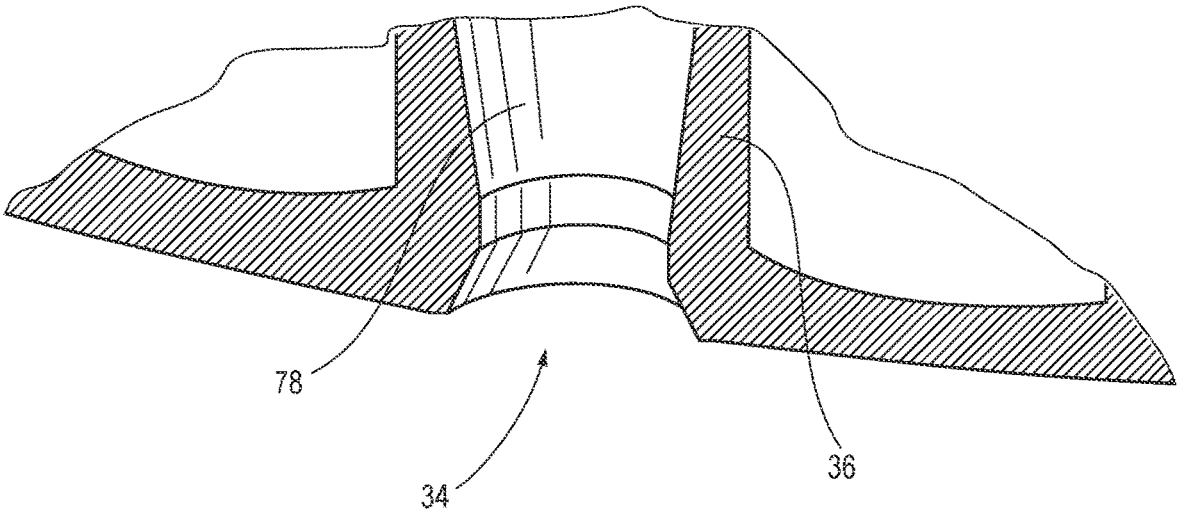
FIG. 11 is a perspective cross sectional view of a portion of the cap in accordance with several embodiments.
Figure 12:
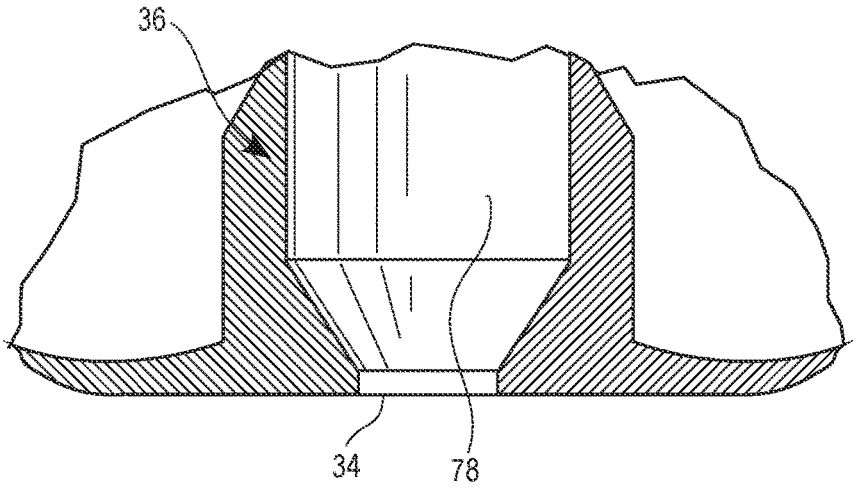
FIG. 12 is a cross sectional view of a portion of the internal shaft at the cap opening in accordance with several embodiments.
Figure 13:
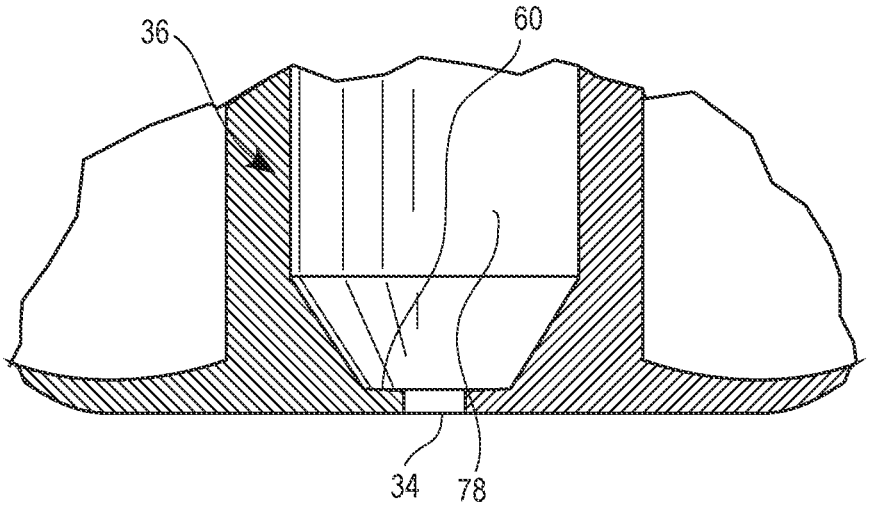
FIG. 13 is a cross sectional view of a portion of the internal shaft at the cap opening in accordance with several embodiments.
Figure 14:
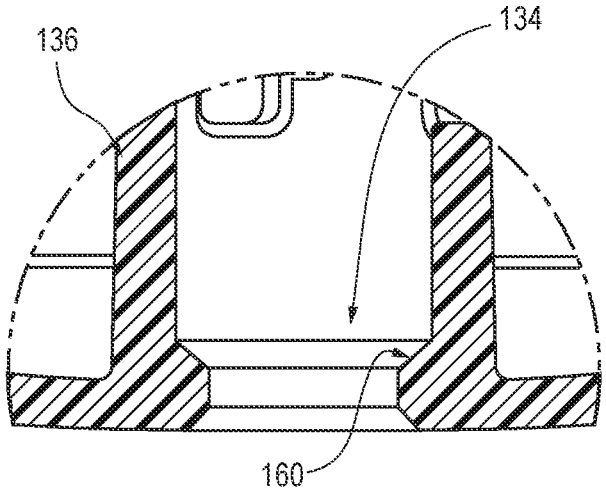
FIGS. 14 and 15 are partial cross sectional views of a portion of alternative embodiments.
Figure 15:
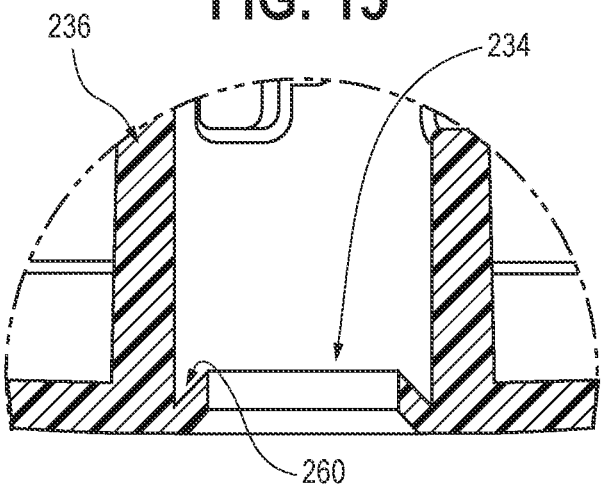

As noted above, the internal shaft 36 may help support the disk 42 when the disk is attached to the base 20. By one approach, the internal or interior wall 78 of the internal shaft 36 funnels fluid 5 toward the opening 34. In one embodiment, the interior wall 78 forms at least one of a circular shape or a parabolic shape. FIG. 11 illustrates one example shape of an interior wall 78 that narrows slightly near the exit of the internal shaft 36. Further, in some embodiments, the shaft 36 may flare open again adjacent the opening 34. By flaring a bit where the opening meets the upper surface of the base, the opening permits the projection 90 to more easily and quickly be placed in the opening 34 when closing the flip-top cap 18. In yet another configuration, shown in FIG. 12, the interior wall 78 has straight portions that are generally vertical and then has angled portions that direct the fluid 5 to the opening 34. FIG. 13 is similar to the internal shaft 36 of FIG. 12, but further includes a cut-off blade 60 or sharp reduction in the diameter of the internal shaft 36 to assist with cessation of dispensing of the fluid 5, as discussed above. Additional examples of cut-off blade configurations or internal projections around the opening are illustrated in. FIGS. 14 and 15. FIG. 14 illustrates an opening 134 with a cut-off blade 160 that has an inner surface that is angled slightly downward or toward the throughopening without a horizontal shelf extending therefrom, whereas the previously discussed FIG. 13 includes a downward angled portions but has a horizontal cut-off blade 60 extending therefrom. Further, FIG. 15 illustrates an opening 234 with a cut-off blade 260 having an inner surface that is angled away from the throughopening.

Figure 16:
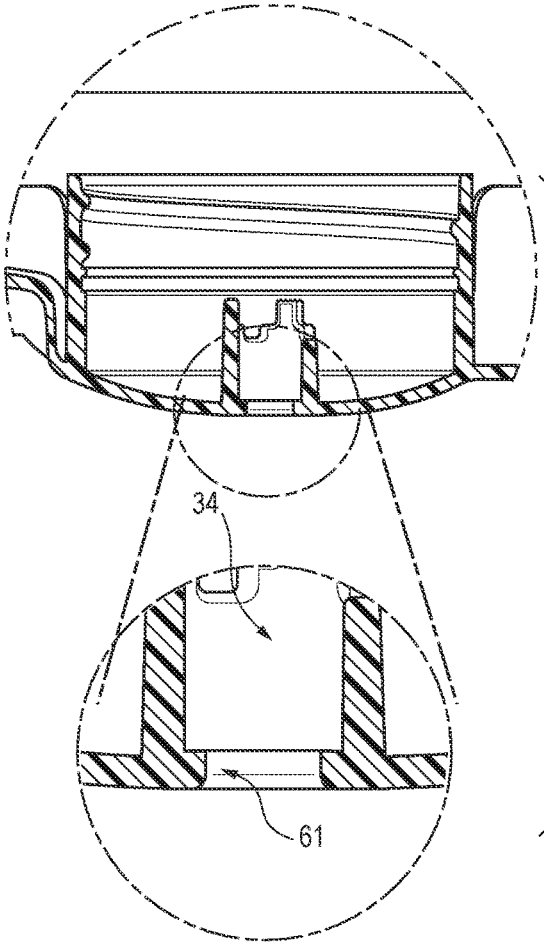
FIGS. 16 and 17 are partial cross sectional views of a portion of the cap in accordance with several embodiments.
Figure 17:
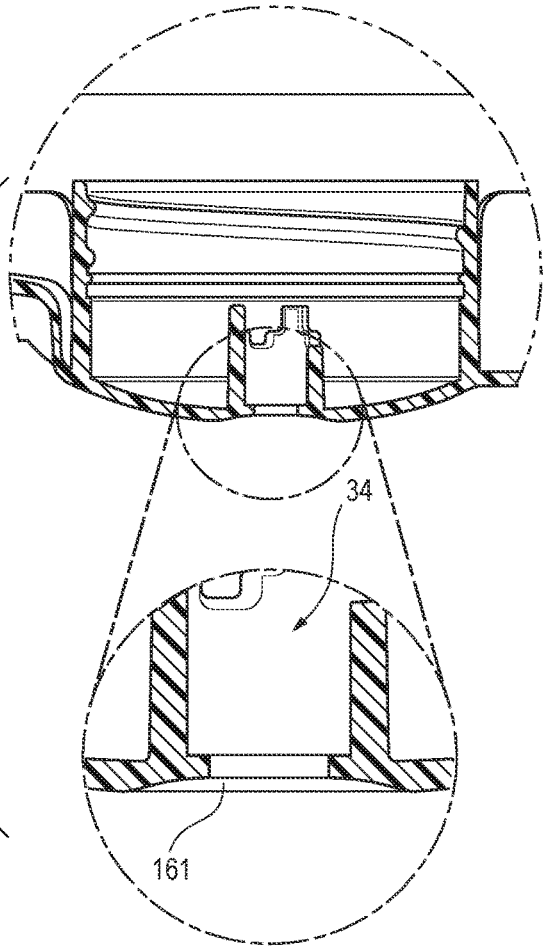

FIGS. 16 and 17 illustrate two options for the configuration of the surface of the container or dome on the outside of the opening 34. For example, FIG. 16 illustrates a rounded edge at the juncture where the central portion 30 meets with the opening 34. Previously discussed FIGS. 14 and 15 have an angled depression around the opening at that location. Further, FIG. 17 illustrates a depression 161 with a sloping wall surface between the central portion 30 and the opening 34.

The bottle 10 and the closure cap 18 may be produced in a number of different manners. In one illustrative approach, a method of manufacturing or producing a filled bottle for dispensing fluid includes molding a receptacle, such as a container body with a threaded neck, filling the receptacle with a fluid, such as a thixotropic fluid, molding a closure cap having a base and a flip-top lid and a disk, and closing the filled receptacle with the closure cap. Further, a bottle may be formed and filled in-line or may be formed at one location and filled at another.

By one approach, the closure cap and disk are separately molded and snapped together. In some configurations, the molded base has an inner and outer skirt with base threads disposed on the inner skirt that are configured to engage the threads on the neck of the receptacle. Further, the molded base may have one or more retaining rings on the inner skirt (a short distance from the threads) and a central, dome-shaped portion having an opening therein aligned with an internal shaft terminating at a non-planar end surface opposite the central, dome-shaped portion. As mentioned above, the opening in the base permits fluid to egress therethrough when the opening is unobstructed. In some configurations, the molded flip-top lid has an interior projection that is movable between a first position and a second position, where the projection blocks the opening of the base inhibiting egress of the fluid inside the container body in the first position, and the second position permits egress of the fluid through the opening of the base.

As mentioned above, the closure cap and disk, in some approaches, are separately molded and then secured to one another or snapped together. In such configurations, the method of manufacturing also may include an assembling step that orients the disk in a particular position relative to the remainder of the closure cap or base 20. By including one or more orientation steps prior to assembling the disk with the remainder of the closure cap, the assembled caps are more likely to have a consistent flow rate therethrough. Further, in some configurations, the flow rate can be adjusted for different fluids by adjusting the relative positioning of certain elements of the closure cap or disk without requiring structural changes thereto. By one approach, a visual mark or indented notch disposed on one or both of the closure cap or disk may be used to help position the disk and/or closure cap relative to one another.

This may depend, in part, on the configuration of the various elements thereof. In one illustrative example, such as the base 20 of FIG. 5, the non-linear terminating surface 38 of the internal shaft 36 includes three cutouts, whereas the disk 42 of FIG. 6, includes four flanges 54. The flow of the fluid through the assembled closure cap may be impacted by the orientation of the flanges 54 relative to the cutout openings of the internal shaft 36. Thus, these two structural elements may be oriented relative to one another to facilitate increased fluid flow therebetween or to slow fluid flow by requiring the fluid to take a longer pathway to the exit of the bottle. Given the interest in adjusting the fluid path or standardizing the flow rate for numerous closure caps, the method of manufacturing or assembling the closure cap and bottle may include orienting the disk in a particular manner relative to the remainder of the closure cap.

As suggested above, the method for producing the filled bottle may include snapping a disk into the retaining ring(s) of the closure cap. The molded disk, in some configurations, includes a central pinhole and partial annular slots disposed around the central pinhole. Once the disk is attached to the remainder of the closure cap 18, the disk 42, the central portion of the base 20, the inner skirt 26, and the internal shaft 36 of the base define a mixing chamber 56 and multiple fluid channels 58 are formed by the non-planar end surface of the internal shaft 36 and the disk 42. The channels 58 formed between the end of the internal shaft 36 and the disk 42 permit fluid to advance from the mixing chamber 56 to the chute formed by the internal shaft 36 that is in communication with the opening 34.

The filled receptacle or container body, in some configurations, is sealed with the fluid therein by a liner associated with the closure cap. For example, a liner, such as a liner of a paperboard, plastic, and/or metallic material is associated with a portion of a retaining ring and when the closure cap 18 is threadingly attached to the container body, the liner seals the fluid 5 in the container.

Further, in some approaches, a method of manufacturing a closure cap includes forming, in a mold, a flip-top closure cap including a base and a flip-top lid. In some embodiments, the molded base has a dome-shaped wall with an opening therethrough and an inner shaft extending therefrom, an inner skirt with threads thereon, an outer skirt connected to the inner skirt by a planar portion and/or possible strengthening ribs, and a retaining ring on the inner skirt. The internal shaft of the molded base generally extends inwardly from the dome-shaped wall and terminates at a non-planar end surface. Further, the molded closure cap also has a flip-top lid hingedly connected to the base, where the flip-top lid has an interior projection and is movable from a first position where the interior projection blocks the opening to a second position where the interior projection does not obstruct the opening of the base. The method of manufacturing the closure cap, in some configurations, further includes snapping a disk into the retaining ring(s) or projection(s) of the base. In some embodiments, the disk has a central pinhole, partial annular slots disposed around the central pinhole, and flanges, that when installed, extend toward the base and are disposed in between the internal shaft and the partial annular slots. Once the disk and base are attached, a mixing chamber is formed between the disk, the dome-shaped wall, the inner skirt, and the internal shaft, wherein multiple fluid channels are formed by the non-planar end surface of the internal shaft and the disk.

In some configurations, the closure cap is made from only two separate components, including the flip-top cap and the disk, where the flip-top cap comprises the base and flip-top lid formed in a single, integral, unitary, one-piece structure, and wherein the two separate components (i.e., the flip-top cap and disk) are made of the same material, and are assembled. In operation, after the closure cap is molded and ejected from the mold, a mechanism can be used to assemble the disk into the closure cap (which can be formed at the same mold as the base and flip-top lid or at a different location), such as, for example, by snapping it into place in the base. Further, the mechanism or another device may be used to attach a liner to the retaining rings, which may help seal the fluid in the bottle. The base and flip-top lid, in some configurations, are molded in the same mold as the disk; in other configurations, the disk, along with the base and flip-top lid, are separately molded at the same mold. Further, the base and disk may be separately molded and assembled at another station. In yet other configurations, the entire closure cap (including the base, flip-top lid, and disk) might be molded or printed together.

Figure 18:
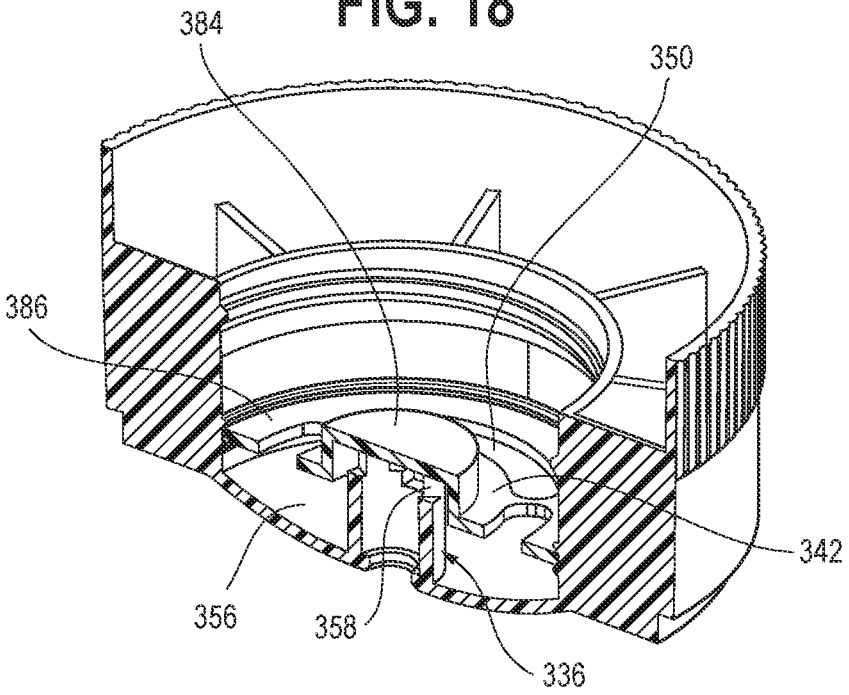
FIG. 18 is a perspective cross sectional view of a portion of a cap showing an alternative embodiment.
Figure 19:
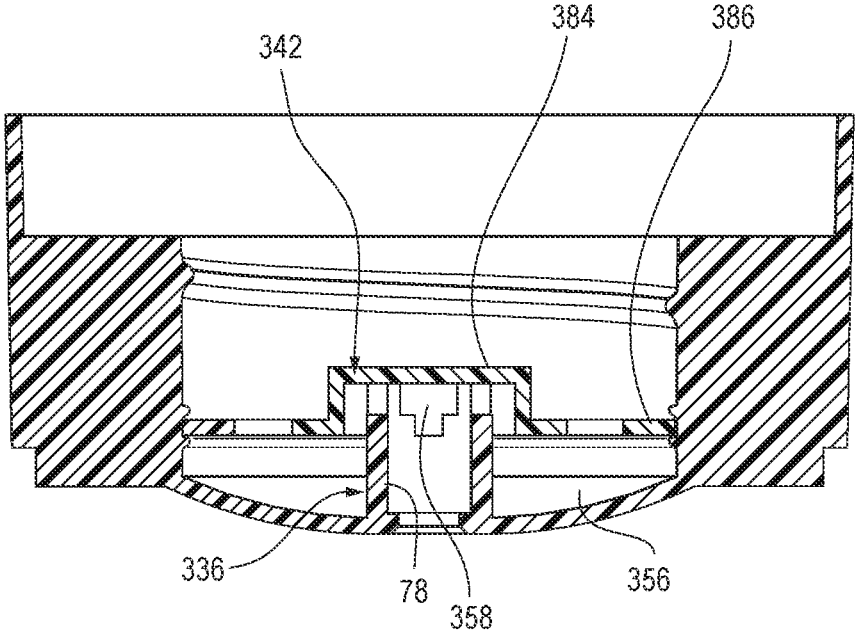
FIG. 19 is a cross sectional view of the embodiment of FIG. 18.
Figure 20:
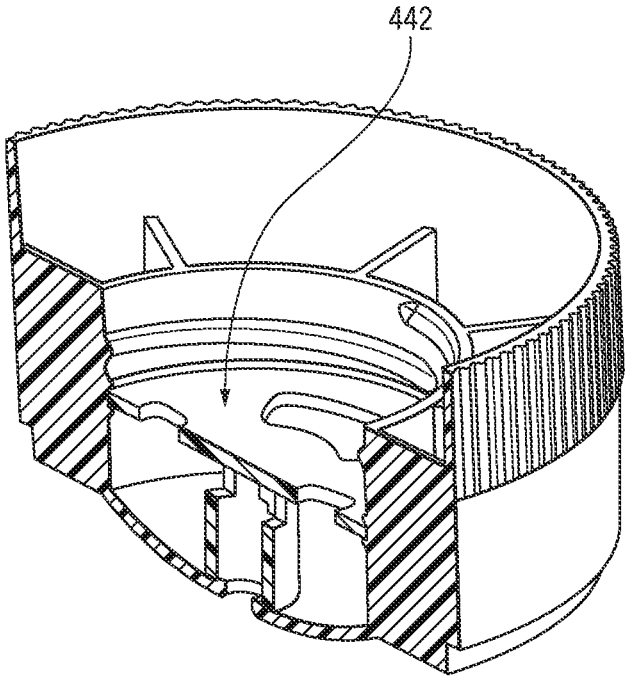
FIG. 20 is a perspective cross sectional view of a portion of a cap showing an alternative embodiment.
Figure 21:
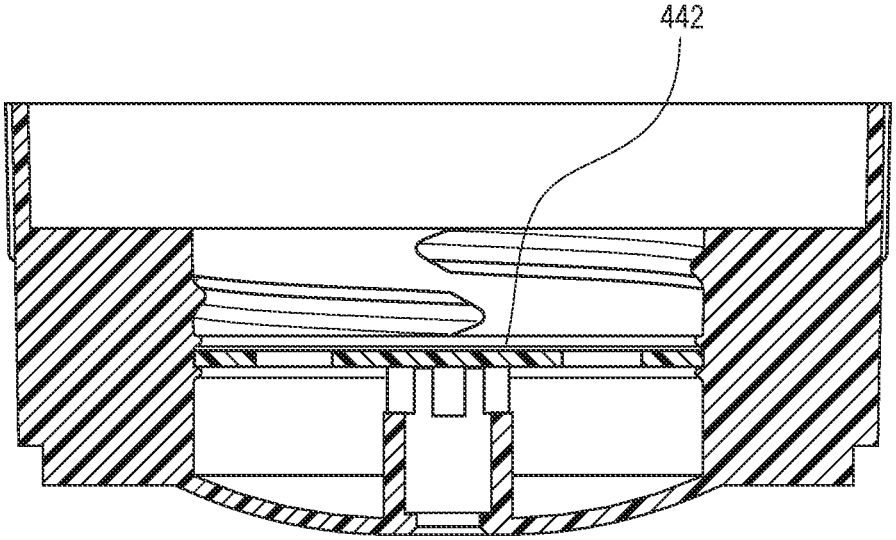
FIG. 21 is a cross sectional view of the embodiment of FIG. 20.

As mentioned above, a number of adjustments to the concepts described herein may be made while remaining consistent with these teachings. For example, FIGS. 18 and 19 illustrate another embodiment of a disk with annular openings. As shown, the disk 342 has a central portion 384 that is disposed a vertical distance from the peripheral portion 386, which has the annular openings 350 disposed therein. In such a configuration, the mixing chamber 356 may be designed to have a volume that is somewhat independent of the volume of the discharge shaft or chamber formed by the internal shaft 356. Indeed, the mixing chamber 356 is somewhat smaller than some of the others discussed above. To permit the flow of fluid 5 from the mixing chamber 356 to the internal shaft 356 forming the discharge chamber, the radius of the central portion 384 may be sufficiently large enough, as compared to the radius of the internal shaft 336 to provide clearance for the fluid 5 to pass from the mixing chamber 356 through the openings or fluid channels 358 formed between the internal shaft 336 and the mixing chamber 356 and/or the openings 358 may extend such that they have a height or location that is disposed beyond the vertical portion of the disk 342 that may be disposed adjacent the internal shaft 336. In short, the openings between the mixing chamber 356 and the internal shaft 358 may be moved or sized to permit fluid flow even if the central portion 384 is not notably larger than the internal shaft. Further, while the central portion 384 is illustrated as lacking a central pinhole in FIGS. 18 and 19, in some configurations, the central portion 384 may include such an air vent formed via a pinhole or other structure. In addition, the disk 342 may be mated to the remainder of the cap in any of the manners, such as, for example, via a snap fit between portions of the base including ribs and/or projections or other complementary geometry between the disk and the base. FIGS. 20 and 21 illustrate another example of a disk 442, which lacks the central pinhole 48 found in some of the other embodiments. Also, while FIGS. 18 and 19 do not include flanges similar to those described above, the vertical portion of the disk separating the central portion 384 and the peripheral portion 386 operates similarly to mix the product therein.

Figure 22:
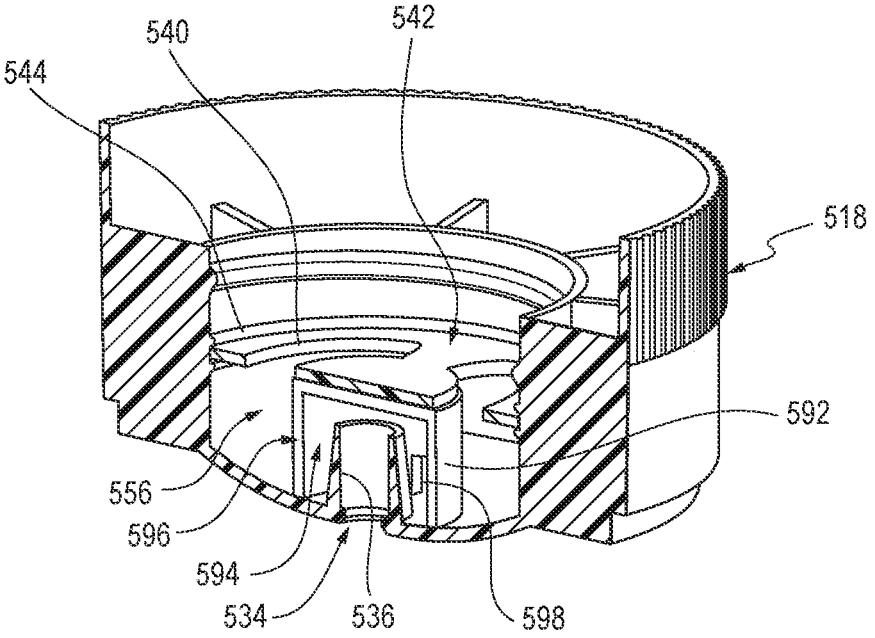
FIG. 22 is a perspective cross sectional view of a portion of a cap showing an alternative embodiment.
Figure 23:
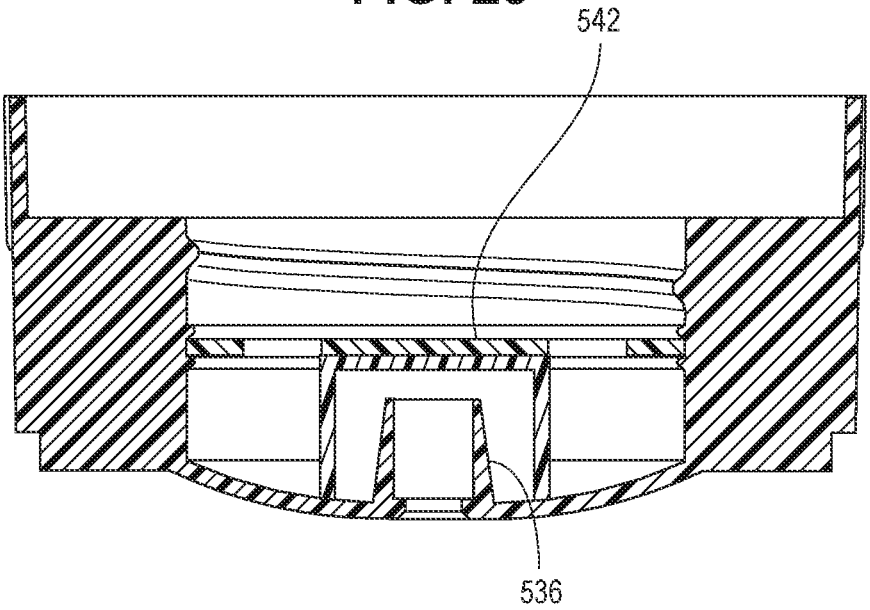
FIG. 23 is a cross sectional view of the embodiment of FIG. 22.
Figure 24:
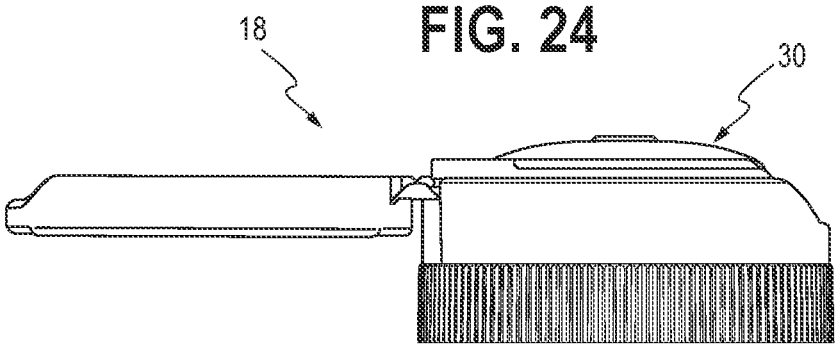
FIG. 24 is a side view of a cap in an open configuration in accordance with several embodiments.

Turning to FIGS. 22 and 23, another embodiment is illustrated and is a three-part solution having a disk 542 that is flat and an inner cap or inner cylindrical housing 596. By one approach, the inner cylindrical housing 596 includes a circular wall 592 with one or more openings 598 disposed therein. In this manner, the mixing chamber 556 is in fluid communication with an intermediate chamber 594 defined, in part, by the inner cylindrical housing 596. By one approach, the inner cylindrical housing 596 is arranged in position about the internal shaft 536 and held into place via the disk 542 that is retained in position by the retaining members 544, such as rings. In addition, the inner cylindrical housing 596 also may be securely attached to the central portion 530. When the inner cylindrical housing 596 is disposed in position about the internal shaft 536, the fluid 5 advances from the bottle to the exit or opening 534 by advancing through the annular openings 540, through the openings 598 of the inner cap 596 and upward along the length of the internal shaft 536 through the internal opening 588 of the internal shaft 536 and down the shaft to the exit opening 534. As shown the disk 542 includes annular openings 540 but lacks a central pinhole because the inner cylindrical housing 596 lacks an opening in the surface thereof between the walls 592. In this manner, the fluid 5 travels and mixes as it advances through the fluid channels of the three-part cap 518. In addition to mixing, this configuration may be particularly useful for larger containers where the downward force on the fluid when the container is inverted are quite large because of the significant amount of product that might be disposed above the cap.

Also, while FIGS. 20-23 are not illustrated as including the flanges extending from the disk, in some configurations, the disks may include flanges similar to those described above.

Figure 25:
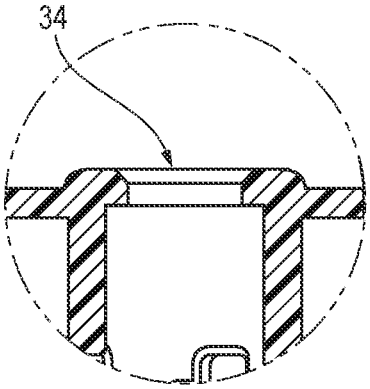
FIGS. 25 and 26 are partial cross sectional views of the cap of FIG. 24.
Figure 26:
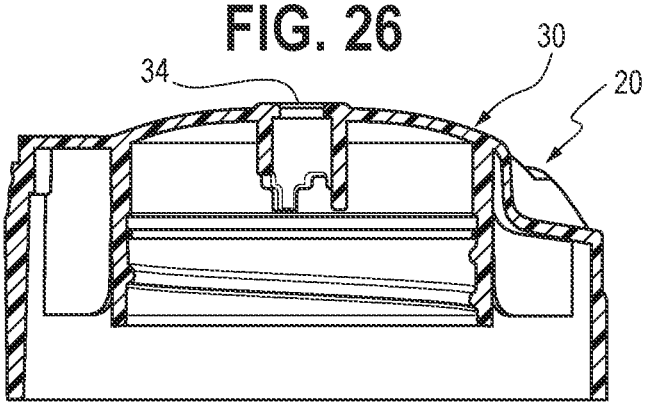
Figure 27:
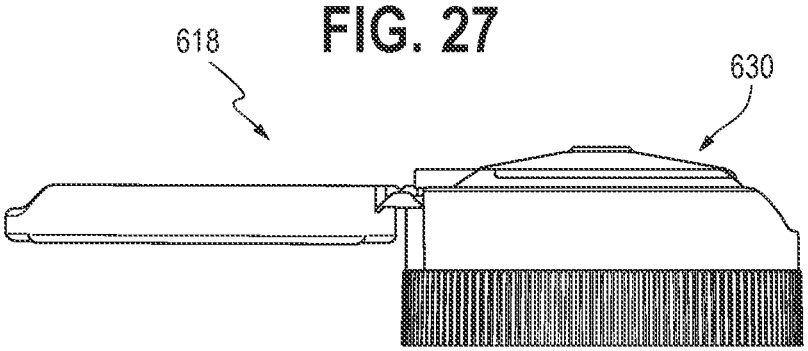
FIG. 27 is a side view of another cap in an open configuration in accordance with several embodiments.
Figure 28:
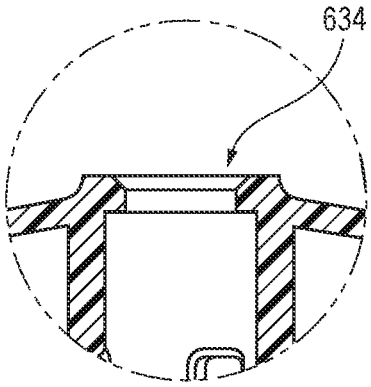
FIGS. 28 and 29 are partial cross sectional views of the cap of FIG. 27.
Figure 29:
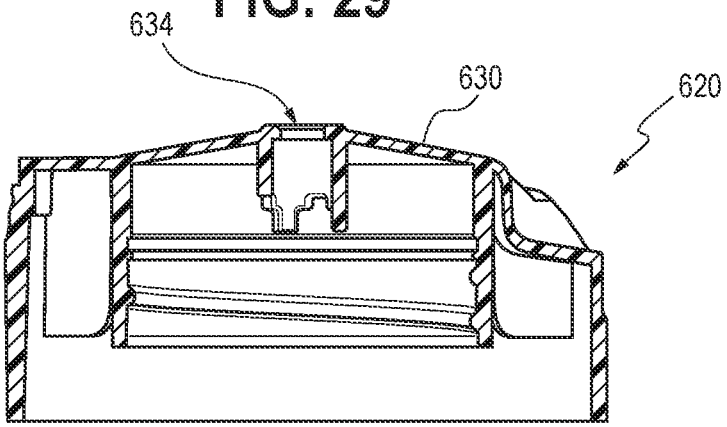
Figure 30:
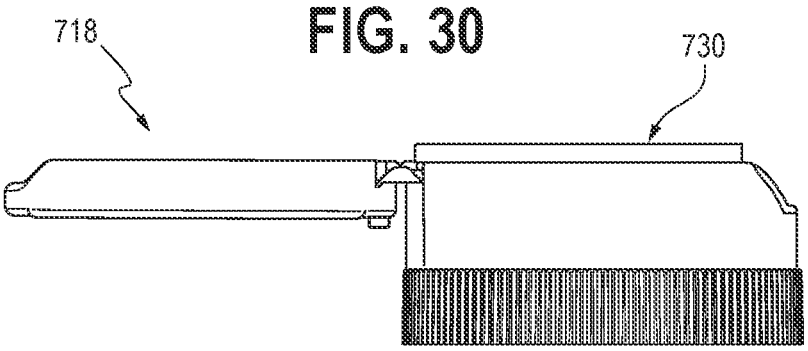
FIG. 30 is a side view of another cap in an open configuration in accordance with several embodiments.
Figure 31:
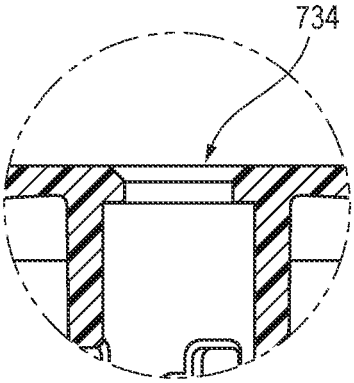
FIGS. 31 and 32 are partial cross sectional views of the cap of FIG. 30.
Figure 32:
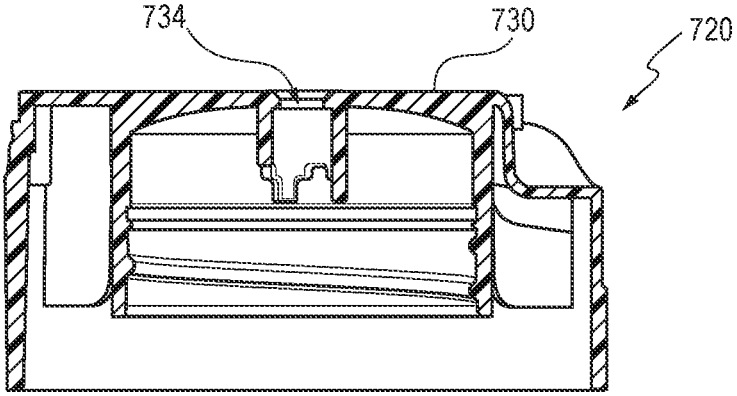

The exterior shape of the central portion of the base also may have a variety of configurations. As noted above, the central portion 30 of the base 20 may have a dome-shaped configuration, such as that incorporated into the cap 18 illustrated in FIG. 24. FIG. 25 illustrates a portion of a cross section of the exit 34 of the dome-shaped central portion 30 of FIG. 24. Further, FIG. 26 further illustrates the dome-shaped central portion in cross section. While the dome-shaped central portion 30 of the base 20 provides a surface that easily wipes clean, other configurations with similar properties may be employed with the teachings described herein. For example, FIG. 27-29 illustrate another exemplary embodiment with a cap 618 having a central portion 630 with a general volcano-shape with sloping walls and an opening 634 disposed in the center thereof. Further, FIGS. 30-32 illustrate yet another embodiment including a cap 718 with a flap central portion 730 and opening therein 734 with flat surfaces surrounding the exterior of the opening 734. Further, while the exemplary shapes shown in FIGS. 24-32 illustrate openings with an exemplary cut-off blades, these various shapes may be incorporated with other opening shapes and aspects described herein.

Figure 33:
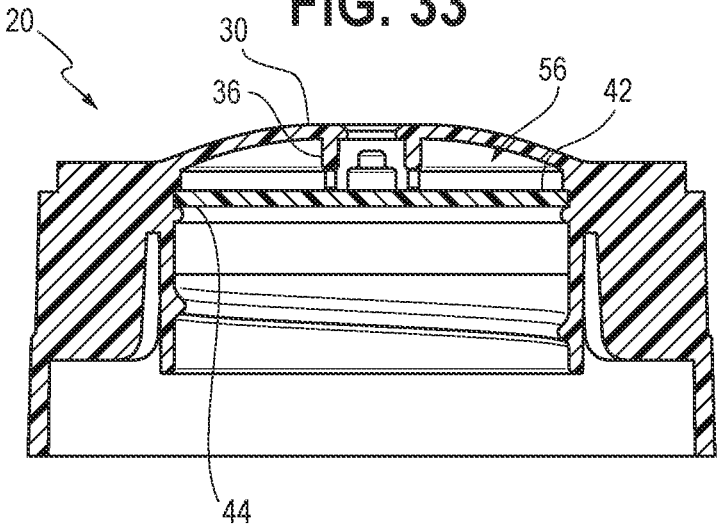
FIGS. 33 and 34 are cross sectional views illustrating alternative mixing chambers.
Figure 34:
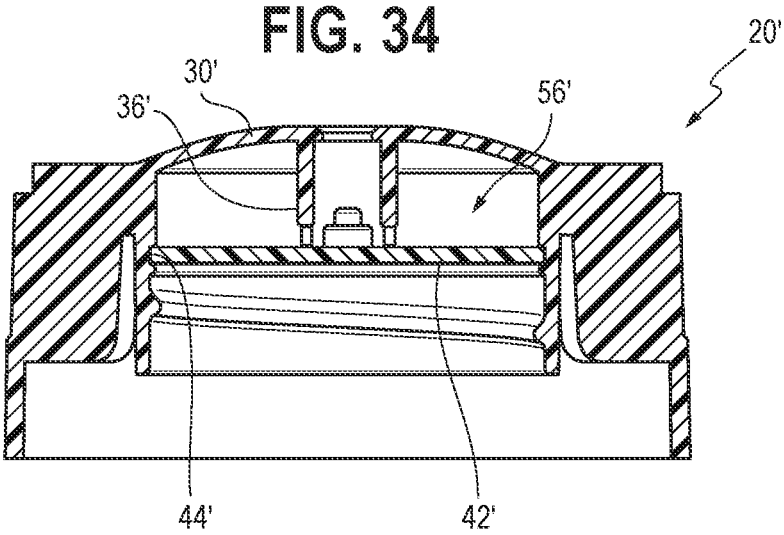

As noted above, the mixing chambers described herein permit separated serum to be incorporated or mixed back into the fluid before the fluid and/or portions thereof are discharged from the opening of the container cap. By one approach, the desired size of the mixing chamber may depend, in part, on the viscosity or other fluid attributes of the fluid or product in the container. By one approach, the size of the mixing chamber 56 is defined, in part, by the size of the internal shaft 36, the location of the disk 42 via the corresponding geometry of the base, and/or the configuration of the disk, as mentioned above. Turning briefly to FIGS. 33 and 34, two differently sized mixing chambers 56 and 56' are illustrated. While the components are similar, the walls forming the internal shaft 36 are longer in FIG. 34 than the walls of shaft 36' in FIG. 33 and the corresponding geometry (such as, for example, the retaining rings 44') are disposed a larger distance away from the central surface 30' of the base 20', as compared to the corresponding geometry (e.g., the retaining rings 44) and central surface 30 of the base 20. While the relative size of these components may change, as shown, the function thereof remains; that is, the mixing chamber assists with preventing separated serum from leaking from the bottle separately from the remainder of the fluid product 5.

Figure 35:
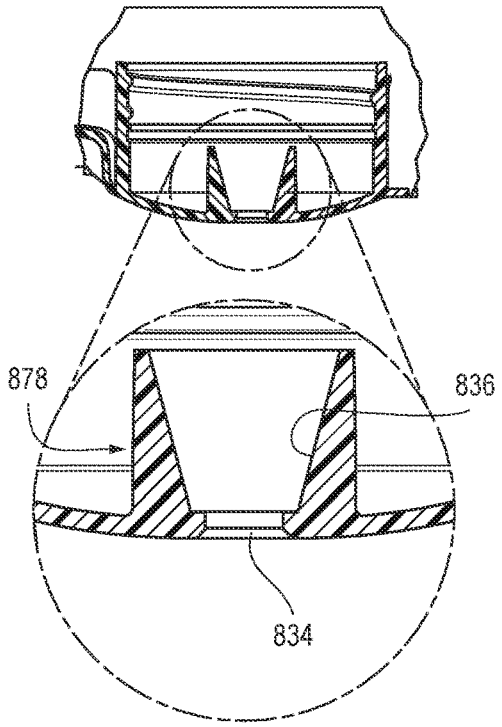
FIGS. 35-37 are partial cross sectional views illustrating alternative internal shafts in accordance with several embodiments.
Figure 36:
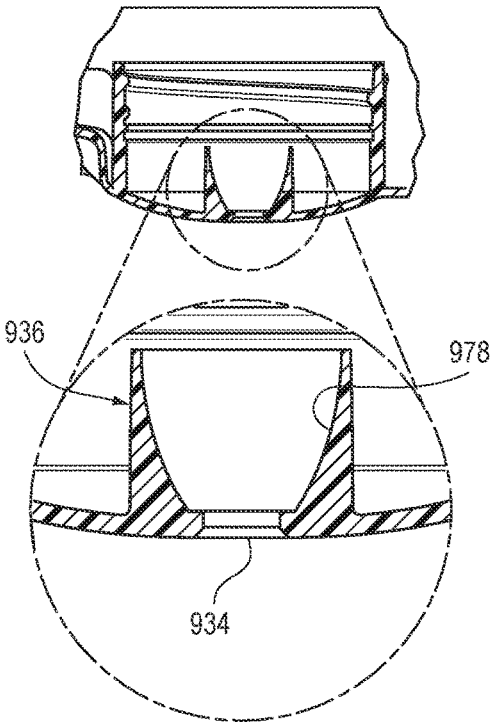
Figure 37:
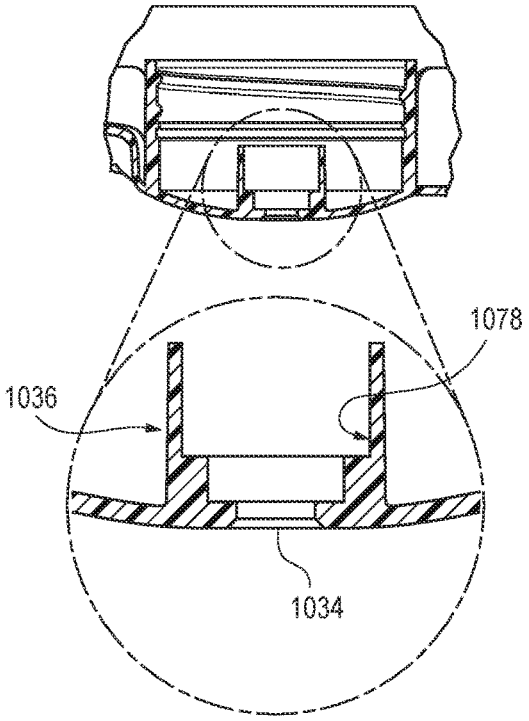

As discussed above, the interior walls 78 of the internal shaft may have a cross section that forms different shapes, such as, for example, a circle or an ellipse, among others. In addition, the shape formed or configuration of the interior wall 78 along the length thereof may adopt a variety of configurations. As illustrated, for example, in FIGS. 4, 14 and 15, the internal shaft 36, 136, 236 may have generally linear interior wall 78 along the height of the internal shaft 36. In other embodiments, the internal shaft 36 may have one or more interior walls 78 that are non-linear. In one embodiment, FIG. 35 illustrates an interior wall 878 of the internal shaft 836 that angles toward the opening 834. By one approach, the downward angle provides the cross section with a v-shaped configuration. In another embodiment, FIG. 36 illustrates an internal shaft 936 having an interior wall 978 with a downward slope that is slightly non-linear. By one approach, the downward slope provides the cross section with a modified u-shape. In another embodiment, FIG. 37 illustrates an internal shaft 1036 having an interior wall 1078 having a stepped configuration that narrows the diameter in a stepped manner.

Figure 49:
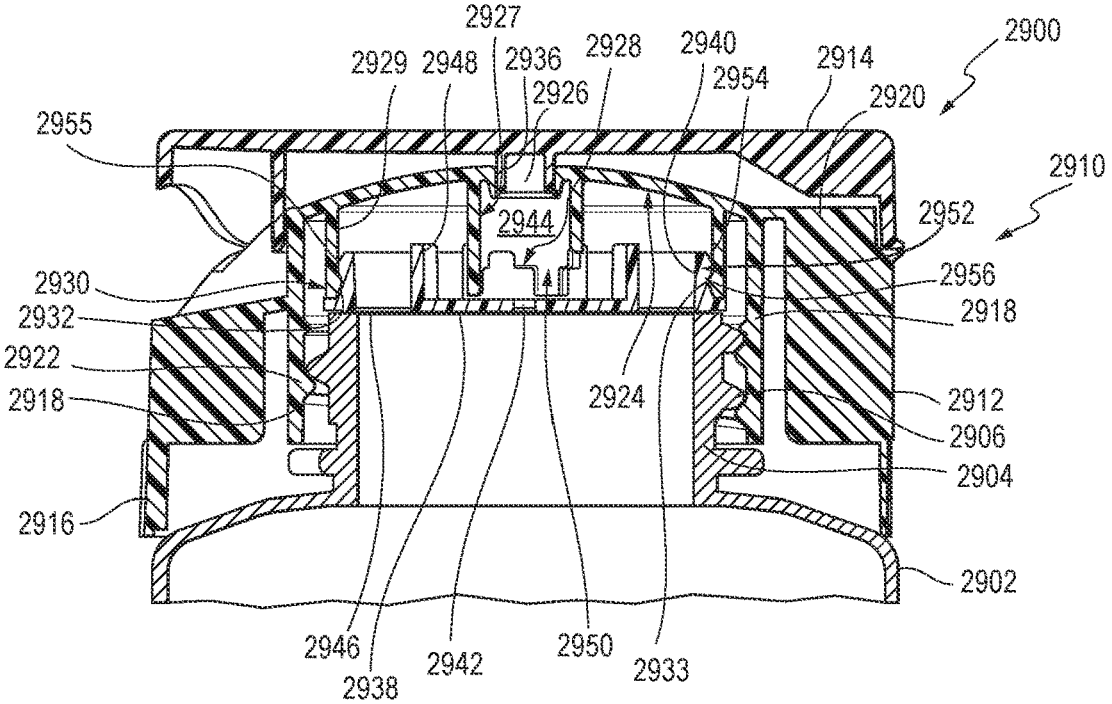
FIG. 49 is a partial cross sectional view of an alternative cap.

Turning to FIG. 49, the cross section of the top portion of a dispensing bottle according to another embodiment is shown. As shown in FIG. 49, dispensing bottle 2900 includes a container body 2902 and a cap 2910. The cap 2910 is configured to selectively allow dosing of the contents of the container body 2902. The container body 2902 may be similar to a container body described above. In use, the container body 2902 may contain a fluid, such as a thixotropic fluid. The container body 2902 typically has a neck 2904 extending from a body portion of the container body 2902. The neck 2904 may have threads 2906 disposed on a surface thereof to threadingly engage a cap, such as cap 2910.

The cap 2910 shown in FIG. 49 has a base 2912 and a flip-top lid 2914. The base 2912 has an outer skirt 2916 and an inner skirt 2918 connected by a planar section 2920. Inner skirt 2918 includes threads 2922 disposed on the internal surface of the skirt. The threads 2922 may be sized and configured to engage the threads 2906 on the neck 2904 of the container body 2902. The base 2912 also includes a dome-shaped central surface 2924 having an opening 2926 disposed therein. The opening 2926 is generally aligned with the internal shaft 2927 that extends from the dome-shaped surface 2924 and terminates at a non-planar end surface 2928, which may take a variety of forms. The non-planar end surface 2928 shown has a stepped configuration, similar to the configuration shown in more detail in FIGS. 8 and 9. In other approaches, however, the non-planar end surface 2928 may have a wavy, sinusoidal or other arcuate configuration such as, for example, the configuration shown in FIG. 10. The central opening 2926 permits fluid to egress from the container body 2902 when the opening 2926 is unobstructed.

The base 2912 further includes an internal annular attachment skirt 2929 depending from the dome-shaped central surface 2924. The end of the attachment skirt 2929 opposite the dome-shaped central surface 2924 typically has geometry that engage with geometry of the disk 2938 that is assembled therewith. In one illustrative approach, the geometry of the attachment skirt 2929 includes an angled tip 2930 on an end thereof. As shown in FIG. 49, the angled tip 2930 has an engaging surface 2932 that faces inward toward the internal shaft 2927. By some approaches, the angled tip 2930 is configured to engage with a portion of the disk 2938 to guide the internal annular attachment skirt 2929 in connecting with the disk 2938, as will be described in more detail below. The internal annular attachment skirt 2929 may further include a ridge 2933 disposed on an internal surface of the internal annular attachment skirt 2929. The ridge 2933 may be an extension of the angled tip 2930 as shown in FIG. 49 or may be independent of the angled tip 2930, for example, disposed on a surface of the internal annular attachment skirt 2929 at a point closer to the dome-shaped central surface 2924. Together, the angled tip 2930 and the ridge 2933 may have a hook or barb configuration such that the angled tip 2930 can be easily snapped over a ridge, rib, or groove, but is more difficult to remove. For example, as shown in FIG. 49, the angled tip 2930 has an engaging surface 2932 extending away from the end of the internal annular attachment skirt 2929 at a slight angle before sharply angling back toward the internal annular attachment skirt 2929 at a point closer to the central surface 2924 of the base 2912, thereby resulting in a secure snap-fit or friction-fit connection between the disk 2938 and the remainder of the cap 2912. In addition, the annular attachment skirt 2929 and the corresponding exterior annular wall 2940 that engages the attachment skirt 2929 are typically comprised of material that permits them to easily flex relative to one another during assembly to accommodate being mated together with a low risk of damage to either portion of the cap 2900.

In addition, the cap 2910 includes a flip-top lid 2914 having an interior projection 2936 disposed on the inner surface of lid 2914. The lid 2914 is typically hingedly connected to the base 2912 to permit the lid 2914 to be reclosably movable between a closed, first position to an open, second position. The hinged connection may be, for example, a living hinge connecting the flip-top lid 2914 and the base 2912. In the closed first position the projection 2936 blocks the opening 2926 of the base 2912 inhibiting egress of the fluid inside the container body 2902. The projection 2936 may be configured to inhibit egress of the fluid without leakage even when the bottle in an inverted position, i.e., the cap 2910 is at the bottom of the dispensing bottle 2900. In the open second position, the projection 2936 is no longer positioned in the opening 2926 of the base 2912, and thus, permits egress of the fluid through the opening 2926.

As mentioned above, the dispensing bottle 2900 also includes a disk 2938, which typically includes an exterior annular wall 2940, one or more pinholes 2942, partial annular slots 2946 disposed around the pinhole 2942, and internal flanges 2948. By one approach, the pinhole 2942 is disposed in a central portion 2944 of the disk 2938, yet in other configurations, the disk may lack a pinhole entirely. As illustrated, the exterior annular wall 2940 has an angled tip 2952 disposed on an end thereof. In FIG. 49, the angled tip 2952 has an engaging surface 2954 that faces partly outward from the exterior annular wall 2940. The angled tip 2952 is configured to engage with the angled tip 2930 of the internal annular attachment skirt 2929 of the base 2912 when attaching the disk 2938 to the base 2912. Like the angled tip 2930 of the internal angular attachment skirt 2929, the angled tip 2952 of the disk 2938 is configured to guide the disk 2938 when connecting the disk 2938 to the base 2912. For example, the angled tip 2952 guides the exterior annular wall to flex inward or outward to snap over a rib or ridge of the internal annular attachment skirt 2929. The exterior annular wall 2940 may further include a ridge 2955 disposed on a surface thereof. As shown in FIG. 49, the ridge 2955 is disposed on the outward facing surface of the exterior annular wall 2940. In some configurations, the ridge 2955 may be an extension of the angled tip 2952 as shown in FIG. 49. In other configurations, the ridge 2955 may be independent of the angled tip 2952, for example, disposed on a surface of the exterior annular wall 2940 at a point closer to the body of the disk 2938. Together, the angled tip 2952 and the ridge 2955 may have a hook or barb configuration such that the angled tip guides the exterior annular wall 2940 over a rib or ridge in one direction, but causes movement in the reverse direction over the rib or ridge to be more difficult. For example, as shown FIG. 49, the angled tip 2952 at the end of exterior annular wall 2940 has an engaging surface 2954 extending away from the exterior annular wall 2940 at a slight angle before sharply angling back toward the exterior annular wall 2940 at the base 2956 of the tip 2952 a point closer to the body of the disk 2938. In operation, the slight angle typically allows the disk to be slid over a ridge with ease in the direction where the slight angled surface engages the ridge, while the sharp angled surface causes movement over the ridge in the reverse direction to require more force.

Figure 50:
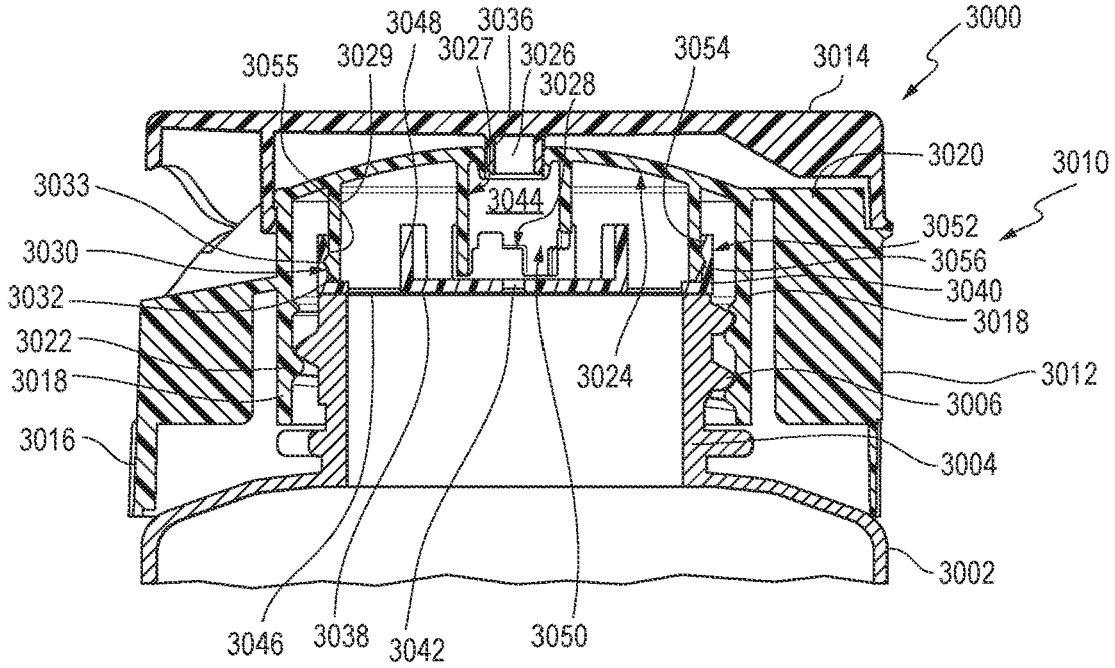
FIG. 50 is a partial cross sectional view of another alternative cap.
Figure 51:
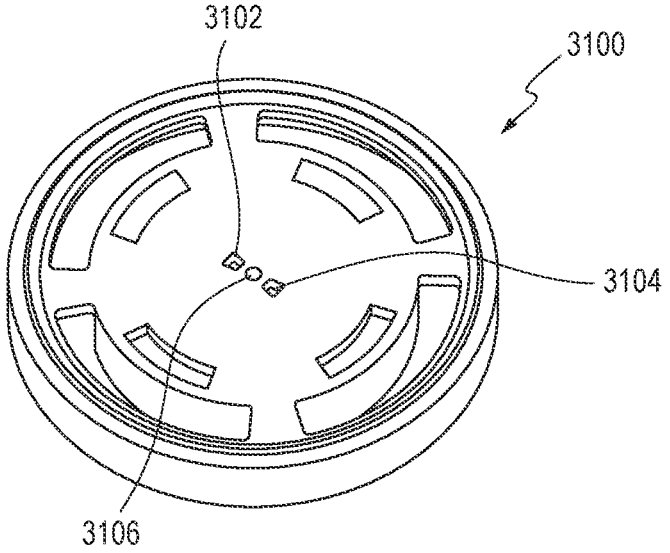
FIG. 51 includes a perspective view of a portion of an alternative cap.

As noted above, the pinhole 2942 may be disposed in a central portion 2944 of the disk or may be offset therefrom. As shown in FIG. 48, the pinhole 2542 is located at the geometrical center of the disk 2538. The pinhole 2942 typically allows air to flow into the container body 2902 during use of the dispenser 2900. In an alternative embodiment shown in FIG. 51, the disk 3100 may have two pinholes 3102, 3104 rather than a single pinhole. Similar to the pinhole previously discussed, such as that illustrated in FIG. 45F, the pinholes 3102, 3104 may be offset from the center point 3106 of the disk 3100. This configuration may be of interest where the disk 3100 is injection molded, so that the injection point can be in the center of the disk 3100. The pinholes 3102, 3104 may both be the same distance from the center point 3106 of the disk 3100 or may each be a different distance from the center point 3106. As shown in FIG. 51, the pinholes 3102, 3104 are symmetrical across the center point 3106. In some alternative embodiments, the pinholes 3102, 3104 may be asymmetrical over the center point 3106. For example, both pinholes 3102, 3104 may be adjacent to the same partially annular slot. While the embodiment shown in FIG. 50 shows two pinholes, configurations with more than two pinholes offset from the center point are also contemplated. In addition, the pinhole may have a variety of shapes, or the disk may lack any pinholes.

When attaching the disk 2938 to the base 2912, the disk 2938 is aligned with the base 2912 such that the engaging surface 2932 of the annular angled tip 2930 of the base 2912 contacts the engaging surface 2954 of the annular angled tip 2952 of the disk 2938. Force is applied to urge the disk 2938 and the base 2912 together. As force is applied, the angled engaging surfaces 2932, 2954 of the internal annular attachment skirt 2929 and the external annular wall 2940 cause the internal annular attachment skirt 2929 and the external annular wall 2940 to flex or elastically deflect away from one another as the angled engaging surfaces 2932, 2954 slide over each other. Once the angled tip 2930 of the base 2912 has passed beyond the ridge 2955 of the disk 2938, the internal annular attachment skirt 2929 elastically returns or springs back to its original non-flexed state. Likewise, once the angled tip 2952 of the disk 2938 has passed beyond the ridge 2955 of the internal annular attachment skirt 2929, the exterior annular wall 2940 elastically returns or springs back to its original non-flexed state. Thus, in the embodiment of FIG. 49, once the angled tips 2930, 2952 have passed beyond the ridges 2933, 2955 the base 2912 and the disk 2938 are held or secured together, unless pried apart from one another. Force in the opposite direction causes the ridge 2933 of the base 2912 to contact the ridge 2955 of the disk 2938. Because the angle of the side of the ridge 2933 proximal to dome-shaped surface 2924 is great relative to the internal annular attachment skirt 2929 and the angle do the side of the ridge 2955 proximal the disk 2938 is great relative to the exterior annular wall 2940, a greater amount of force is required to cause the internal annular attachment skirt 2929 and the exterior annular wall 2940 to flex away from one another to allow the angled tips 2930, 2952 to pass back over the ridges 2933, 2955.

Once assembled, a mixing chamber is formed by the disk 2938, the dome-shaped central portion 2924, the internal annular attachment skirt 2929, and the internal shaft 2927. Fluid channels are formed by the non-planar end surface 2928 of the internal shaft 2927, the disk 2938, and the partial annular slots 2946 in the disk 2938. In use, the flip-top lid 2914 is moved from the first closed position to the second opened position, such that the projection 2936 does not inhibit egress of fluid through the opening 2926 of the base 2912. Once the bottle 2900 is opened, pressure may be applied to the container body 2902 to control the dispensing of the fluid contained in the container body 2902. Then, once pressure is applied to the container body 2902, fluid is forced to flow out of the container body 2902 along the neck 2904 of the container body 2902 and through the partial annular openings of the disk 2938. The fluid may then flow over or in between the internal flanges 2948 and then through fluid channels in the internal shaft 2927. The fluid then flows along the internal shaft 2927 and exits the dispensing bottle 2900 via the opening 2926 in the base 2912. While the fluid is flowing through the openings and channels of the mixing chamber, the flow of the fluid causes the fluid to be mixed as described in more detail above.

When pressure is removed from the container body 2902, the fluid promptly ceases to exit the dispensing bottle. This is partly due to air being permitted to flow back into the container body 2902. Air may be admitted into the container body 2902 by, for example, the opening 2926 and the pinhole 2942, the partial annular slots 2946, or both. This causes the container body 2902 to spring back to its original non-pressurized state, thus causing the flow of the fluid in the interior channel to be reversed without movement of the disk 2938 relative to the base 2912.

Turning now to FIG. 50, a dispensing bottle 3000 is shown that is similar to the bottle 2900 described above, with the prefix of the reference numeral "29" replaced by "30" for similar structures. The dispensing bottle 3000 includes a container body 3002 and a cap 3010, the cap 3010 including a base 3012 and a flip-top lid 3014 similar to the cap 2910 described in regard to FIG. 49. Similar to the base 2912 of the embodiment of FIG. 49, the base 3012 includes an internal annular attachment skirt 3029 depending from the dome-shaped central surface 3024. The end of the attachment skirt 3029 opposite the dome-shaped central surface 3024 typically has geometry that engages with geometry of the disk 3038 that is assembled therewith. Unlike the embodiment shown in FIG. 49, the angled tip 3030 has an engaging surface 3032 that faces outward and away from the internal shaft 3027 rather than inward. The angled tip 3030 may be similar to the angled tip 2930 of FIG. 49 in all other respects apart from the orientation. The angled tip 3030 may be configured to engage with a portion of the disk 3038 to guide the internal annular attachment skirt 3029 in connecting with the disk 3038. The internal annular attachment skirt 3029 may further include a ridge 3033 disposed on an external surface of the internal annular attachment skirt 3029. The ridge 3033 may be an extension of the angled tip 3030 as shown in FIG. 50 or may be independent of the angled tip 3030, for example, disposed on a surface of the internal annular attachment skirt 3029 at a point closer to the dome-shaped central surface 3024. Similar to the embodiment of FIG. 49, the angled tip 3030 and the ridge 3033 may together have a hook or barb configuration such that the angled tip 3030 can be easily snapped over a ridge, rib, or groove, but is more difficult to remove. The annular attachment skirt 3029 and the corresponding exterior annular wall 3040 that engages the attachment skirt 3029 are typically comprised of material that permits them to easily flex relative to one another during assembly to accommodate being mated together with a low risk of damage to either portion of the cap 3010.

The dispensing bottle 3000 also includes a disk 3038. The disk 3038 may be similar to disk 2938 of FIG. 49 and include an exterior annular wall 3040, a pinhole 3042, partial annular slots 3046 disposed around the pinhole 3042, and internal flanges 3048. The disk 3038 of FIG. 50 differs from the disk 2938 of FIG. 49 in that the angled tip 3052 of the exterior annular wall 3040 has an engaging surface 3054 that faces partly inward from the exterior annular wall 3040. Similar to the angled tip 2952 of FIG. 49, the angled tip 3052 is configured to engage with the angled tip 3030 of the internal annular attachment skirt 3029 of the base 3012 when attaching the disk 3038 to the base 3012. Like the angled tip 3030 of the internal angular attachment skirt 3029, the angled tip 3052 of the disk 3038 is configured to guide the disk 3038 when connecting the disk 3038 to the base 3012. For example, the angled tip 3052 guides the exterior annular wall to flex inward or outward to snap over a rib or ridge of the internal annular attachment skirt 3029. The exterior annular wall 3040 may further include a ridge 3055 disposed on a surface thereof. As shown in FIG. 50, the ridge 3055 is disposed on the inward facing surface of the exterior annular wall 3040. In some configurations, the ridge 3055 may be an extension of the angled tip 3052 as shown in FIG. 50. In other configurations, the ridge 3055 may be independent of the angled tip 3052, for example, disposed on a surface of the exterior annular wall 3040 at a point closer to the body of the disk 3038. Together, the angled tip 3052 and the ridge 3055 may have a hook or barb configuration such that the angled tip guides the exterior annular wall 3040 over a rib or ridge in one direction, but causes movement in the reverse direction over the rib or ridge to be more difficult. Attachment of the disk 3038 to base 3012 may be done in a manner similar to the method described in regard to FIG. 49.

While the embodiments disclosed in FIGS. 49 and 50 show both the base and the disk having an angled tip, there are also embodiments where only one of the base or the disk have an angled tip. For example, the base may have an angled tip and the disk may have a ridge or even an annular recess or groove extending around the external annular wall. The angled tip of the base may be configured to slide along a surface of the exterior annular wall and snap over the ridge or into the annular recess or groove disposed on the external annular wall. In a similar embodiment, the disk has the angled tip, while the base has the ridge, annular recess, or groove disposed on an annular surface of the interior annular attachment skirt that the angled tip snaps into.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

What is claimed is:

1. A dispensing bottle comprising:

a container body having a neck with threads thereon;

a cap having a base and a flip-top lid, the flip-top lid being movable between a closed first position to an open second position, and the base having an inner skirt with base threads disposed thereon, the base threads configured to engage the threads on the neck, a central portion having an opening therein aligned with an internal shaft, the opening permitting fluid to egress therethrough when the opening is unobstructed, and an internal annular attachment skirt extending from the central portion and having an angled tip and a protrusion to form a ridge, a disk having a body, an annular wall extending therefrom and one or more openings therethrough, the annular wall having an angled tip on an end thereof, the annular wall having a protrusion to form a ridge, the disk attached to an interior of the base by interengagement of the ridge of the disk and the ridge of the internal annular attachment skirt; and a mixing chamber defined by the disk, the central portion, the internal annular attachment skirt, and the internal shaft, wherein multiple fluid channels are formed by the internal shaft and the disk.

2. The dispensing bottle of claim 1 wherein the internal shaft terminates at a non-planar end surface.

3. The dispensing bottle of claim 1 wherein the one or more openings of the disk comprises partial annular slots disposed in the disk.

4. The dispensing bottle of claim 3 wherein the disk further comprises flanges extending from the disk toward the central portion of the base.

5. The dispensing bottle of claim 4 wherein the partial annular slots comprise a plurality of large partial annular slots and a plurality of small partial annular slots wherein one of the flanges are disposed between each of the large and small partial annular slots.

6. The dispensing bottle of claim 3 wherein the one or more openings of the disk further includes one or more pinholes.

7. The dispensing bottle of claim 1 wherein the flip-top lid further comprises a projection that blocks the opening of the base inhibiting egress of a fluid disposed in the dispensing bottle.

8. The dispensing bottle of claim 1 wherein the interengagement of the angled tip of the disk and the angled tip of the internal annular attachment skirt includes a surface of the ridge of the disk contacting a surface of the ridge of the internal annular attachment skirt.

9. The dispensing bottle of claim 1 wherein the central portion forming the opening includes an inwardly projecting blade on an interior of the central portion.

10. The dispensing bottle of claim 1 wherein the central portion has an external central depression with a sloping wall toward the opening of the central portion.

11. The dispensing bottle of claim 1 wherein the body of the disk has a stepped configuration.

12. A closure cap for a container, the closure cap comprising:

a base and a flip-top lid, the flip-top lid being movable between a closed first position to an open second position, and the base having an inner skirt with base threads disposed thereon, the base threads configured to engage threads on a bottle neck, a central portion having an opening therein aligned with an internal shaft, the opening permitting fluid to egress therethrough when the opening is unobstructed, and an internal annular attachment skirt extending from the central portion and having an angled tip and a protrusion to form a ridge, a disk having a body, an annular wall extending therefrom and one or more openings therethrough, the annular wall having an angled tip on an end thereof, the annular wall having a protrusion to form a ridge, the disk attached to an interior of the base by interengagement of the ridge of the disk and the ridge of the internal annular attachment skirt; and a mixing chamber defined by the disk, the central portion, the internal annular attachment skirt, and the internal shaft, wherein multiple fluid channels are formed by the internal shaft and the disk.

13. The closure cap of claim 12 wherein the internal shaft terminates a non-planar end surface.

14. A closure cap for a container, the closure cap comprising:

a base having an outer skirt, an inner skirt with internal threads therein, a central portion with an opening therethrough and an internal shaft, and an internal annular attachment skirt extending from the central portion, an end of the attachment skirt opposite the central portion having attachment geometry;

a flip-top lid hingedly connected to the base; and a disk having a body, an annular wall with securement geometry complementary to the attachment geometry of the attachment skirt, and one or more openings in the body of the disk, the disk being formed of a single, rigid material; and a mixing chamber defined by the disk, the central portion of the base, the internal annular attachment skirt, and the internal shaft, wherein multiple fluid channels are formed by the internal shaft and the disk.

15. The closure cap of claim 14 wherein the internal shaft terminates at a non-planar end surface.

16. The closure cap of claim of claim 14 wherein the one or more openings of the disk include a plurality of partial annular openings.

17. The closure cap of claim 16 wherein the disk further comprises flanges extending from the disk toward the central portion of the base.

18. The closure cap of claim 17 wherein the plurality of partial annular openings comprises a plurality of large partial annular slots and a plurality of small partial annular slots and wherein one of the flanges are disposed between one of the large partial annular slots and one of the small partial annular slots.

19. The closure cap of claim 14 wherein the securement geometry comprises an angled tip and a protrusion forming a ridge and the attachment geometry comprises an angled tip of the attachment wall and a protrusion to form a ridge.

20. The closure cap of claim 14 wherein the central portion forming the opening includes an inwardly projecting blade on an interior of the central portion.

21. The closure cap of claim 14 wherein the central portion has an external central depression with a sloping wall toward the opening of the central portion.

22. The closure cap of claim 14 wherein the body of the disk has a stepped configuration.

23. A dispensing bottle comprising:

a container body having a neck with threads thereon;

a cap having a base and a flip-top lid;

the base having an outer skirt, an inner skirt with internal threads therein, a central portion with an opening therethrough and an internal shaft, and an internal annular attachment skirt extending from the central portion, an end of the attachment skirt opposite the central portion having attachment geometry;

the flip-top lid hingedly connected to the base; and a disk having a body, an annular wall with securement geometry complementary to the attachment geometry of the attachment skirt, and one or more openings in the body of the disk, the disk being formed of a single, rigid material; and a mixing chamber defined by the disk, the central portion of the base, the internal annular attachment skirt, and the internal shaft, wherein multiple fluid channels are formed by the internal shaft and the disk.

24. The dispensing bottle of claim 23 wherein the internal shaft terminates at a non-planar end surface.

* * * * *